US006510793B1

(12) United States Patent
Kerr et al.

(10) Patent No.: US 6,510,793 B1
(45) Date of Patent: Jan. 28, 2003

(54) IMAGING APPARATUS AND PRINTING PLATE MOUNTING SURFACE FOR USE IN AN IMAGING APPARATUS HAVING PRINTING PLATE REGISTRATION DETECTION

(75) Inventors: Roger S. Kerr, Brockport, NY (US); John D. Gentzke, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/894,551

(22) Filed: Jun. 28, 2001

(51) Int. Cl.[7] ..... B41F 27/00
(52) U.S. Cl. ..... 101/382.1; 101/415.1
(58) Field of Search ..... 101/382.1, 415.1

(56) References Cited

U.S. PATENT DOCUMENTS

| | | | | |
|---|---|---|---|---|
| 2,145,520 A | | 1/1939 | McFarlane | |
| 3,191,530 A | | 6/1965 | Fath et al. | |
| 3,595,567 A | | 7/1971 | Lee et al. | |
| 4,127,265 A | | 11/1978 | Wirz et al. | |
| 5,097,763 A | * | 3/1992 | Simeth | 101/382.1 |
| 5,320,041 A | * | 6/1994 | Maejima et al. | 101/415.1 |
| 5,383,402 A | * | 1/1995 | Takano et al. | 101/415.1 |
| 5,394,614 A | * | 3/1995 | Lindner et al. | 101/415.1 |
| 5,461,980 A | * | 10/1995 | Maejima et al. | 101/415.1 |
| 5,479,859 A | | 1/1996 | Lindner et al. | |
| 5,806,431 A | * | 9/1998 | Muth | 101/415.1 |
| 5,992,325 A | | 11/1999 | Schumann et al. | |
| 6,314,884 B1 | * | 11/2001 | Reiner | 101/481 |
| 6,318,262 B1 | * | 11/2001 | Wolber et al. | 101/401.1 |
| 6,321,651 B1 | * | 11/2001 | Tice et al. | 101/248 |

FOREIGN PATENT DOCUMENTS

| | | | | |
|---|---|---|---|---|
| DE | 298 08 098 U1 | * | 7/1998 | B41F/13/12 |
| DE | 298 08 099 U1 | * | 7/1998 | B41F/13/12 |

* cited by examiner

*Primary Examiner*—Andrew H. Hirshfeld
*Assistant Examiner*—Charles H. Nolan, Jr.
(74) *Attorney, Agent, or Firm*—Roland R. Schindler, II

(57) ABSTRACT

In accordance with the present invention, an imaging apparatus is provided for forming images on an electrically conductive printing plate. The imaging apparatus has a mounting surface having at least three electrically isolated conductors arranged so that when the electrically conductive printing plate is in registration on the mounting surface, the electrically conductive printing plate defines an electrical connection between all of the electrical conductors; and, an electrical circuit adapted to sense an electrical connection between all of the conductors and to thereupon generate an output signal.

38 Claims, 18 Drawing Sheets

IMAGING APPARATUS AND PRINTING PLATE MOUNTING SURFACE FOR USE IN AN IMAGING APPARATUS HAVING PRINTING PLATE REGISTRATION DETECTION

CROSS REFERENCE TO RELATED APPLICATIONS

Cross reference is made to commonly assigned and co-pending U.S. Pat. App. Ser. No. 09/845,145, filed Apr. 30, 2001.

FIELD OF THE INVENTION

The present invention relates to imaging apparatuses and imaging drums for use in an imaging apparatus that forms an image on printing plates or uses a printing plate to apply ink to a receiver media to form an image. In particular, the present invention relates to an imaging apparatus and imaging drum having automatic plate registration detection.

BACKGROUND OF THE INVENTION

Contact printing remains the most economical method for printing a large number of copies of an image. Contact printing presses utilize printing plates to apply ink to a receiver media to form an image on the media. In this regard, the printing plates have a printing surface with a pattern of markings representing the image to be printed. Prior to printing, the printing plate is fixed to a plate mounting surface. During printing, ink is applied to the printing surface and the printing surface is brought into contact with a receiver media such as paper. An ink pattern is thereby transferred to the receiver media forming an image on the receiver media.

It is essential to ensure that the contact printing plate is properly aligned with the receiver media during printing. To accomplish this, it is necessary to properly align the printing plate on the mounting surface and to properly adjust the position of the printing plate on the plate mounting surface. A printing plate that is properly aligned and positioned is known in the art as being "in registration."

In certain types of printing, more than one printing plate is used to apply ink to form an image on the receiver media. Typically, each printing plate applies a differently colored ink to the receiver media. In this way, the image formed on the receiver media can contain different colors. It will be understood that each printing plate must be in registration when the color image is formed. If the printing plates are not in registration, the image will appear out of focus and the colors in the image will be incorrect.

Before the printing plate is used for printing, an image is formed on the printing plate. A printing plate imaging apparatus is used to form the image on the printing plate. It is necessary to properly register the printing plate during this process. If a printing plate is not in registration when an image is formed on the printing plate, then the printing plate will not generate proper images when it is used for printing.

Thus, there is a need in the art for an imaging apparatus having an image mounting surface adapted to detect registration of a printing plate on an imaging surface.

There have been various attempts to meet this need in the prior art. For example U.S. Pat. No. 5,992,325 shows a method and device for automatically detecting the location of at least one printing plate edge on a plate mounting surface. As shown in this patent, a plate cylinder for a printing press includes a linear array of clamps that hold a trailing or leading edge of the printing plate. Mechanical sensors in the clamps trigger electrical switches. The switches provide an electrical indication of whether the trailing or leading edge of printing plate is positioned within the clamps. When the edge of the plate is detected at each clamp in the array, the plate is considered to be in registration.

U.S. Pat. Nos. 3,595,567 and 4,127,265 show similar structures for determining whether a sheet of receiver media is in registration with a drum. Each of these patents shows two linear arrays of clamps or grippers positioned on opposite sides of the drum. This allows two sheets of material to be held to the drum thus requiring two sets of sensors to detect the alignment of the sheets. U.S. Pat. No. 2,145,520 shows a mechanical structure to accomplish this result.

U.S. Pat. No. 5,479,859 shows a method and apparatus for controlling an automated printing plate change process in a sheet-fed offset printing machine. In this patent, a pair of clamps are used to hold a printing plate in registration. The clamps are arranged in a linear fashion on the drum and have register pins to grip printing plates against a gripping portion. The register pins are electrically insulated from the gripping portion and engage notches in the plate. When the printing plate is in proper registration, bottom edges of the notches seat on and contact the register pins. This provides a conductive electrical path from the register pins to the gripping portion. By sensing whether such a conductive path is formed at each register pin, it becomes possible to determine whether the printing plate is in registration. Thus, in the drum of the '859 patent, a separate electrical path is defined between each register pin and each gripping portion. This requires an emitter of an electrical signal and a receiver of an electrical signal at each clamp. Further, in the '859 patent, the alignment is established by the mechanical positioning between the notches on the leading edge of the plate and the register pins.

Thus, the prior art relies upon the detection of the leading or trailing edge of the printing plate and determines whether the printing plate is in registration based upon the signals received from two or more sensors aligned along a single direction that is parallel with either the leading or trailing edge of the printing plate. Such systems can fail to detect lateral mis-position of the printing plate. Further, such systems are not easily adaptable to accommodate different sizes of printing plates. This is because smaller printing plates may not extend across the linear direction of the clamps so that each clamp contacts a portion of the leading or trailing edge of the plate. In such a circumstance, a drum of the prior art will erroneously indicate that a smaller printing plate is not in registration.

Accordingly, what is needed is an imaging apparatus and a mounting surface for use in an imaging apparatus that overcome the limitations of the prior art.

SUMMARY OF THE INVENTION

In accordance with the present invention, an imaging apparatus is provided for forming images on an electrically conductive printing plate. The imaging apparatus has a mounting surface having at least three electrically isolated conductors arranged so that when the electrically conductive printing plate is in registration on the mounting surface, the electrically conductive printing plate defines an electrical connection between all of the electrical conductors and, an electrical circuit adapted to sense an electrical connection between all of the conductors and to thereupon generate an output signal.

In accordance with another embodiment of the present invention, a mounting surface for receiving electrically conductive printing plates is provided. The mounting surface has at least three electrically isolated conductors arranged so that when the electrically conductive printing plate is in registration on the mounting surface the electrically conductive printing plate defines an electrical connection between all of the electrical conductors and an electrical circuit adapted to sense an electrical connection between all of the conductors and to thereupon generate an output signal.

BRIEF DESCRIPTION OF THE DRAWINGS

While the specification concludes with claims particularly pointing out and distinctly claiming the subject matter of the present invention, it is believed that the invention will be better understood from the following detailed description when taken in conjunction with the accompanying drawings wherein:

DETAILED DESCRIPTION OF THE INVENTION

The present description will be directed in particular to elements forming part of, or co-operating more directly with, an apparatus in accordance with the present invention. Elements not specifically shown or described may take various forms well known to those skilled in the art.

Figure 1:
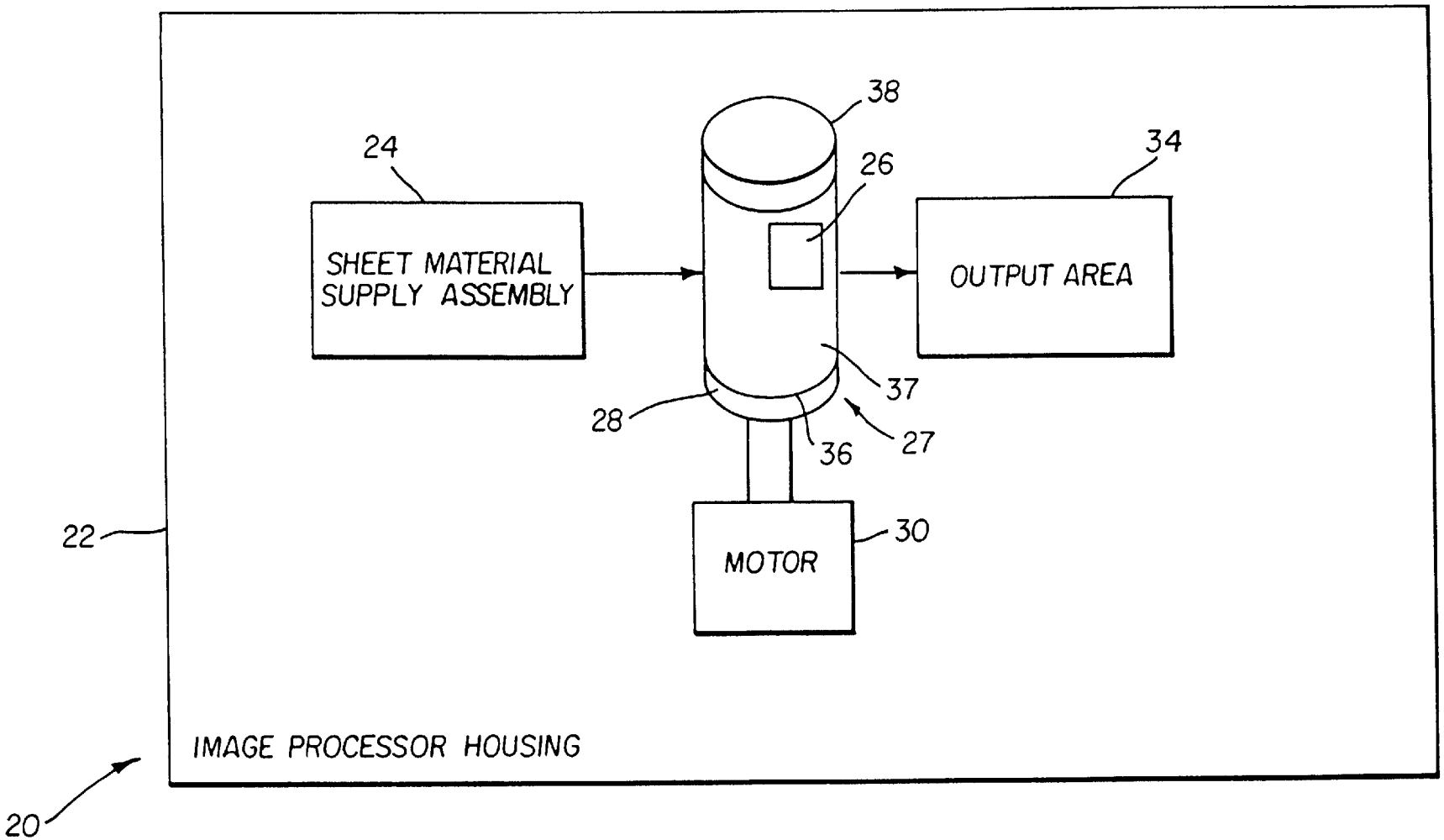
FIG. 1 shows a schematic view of embodiment of an imaging apparatus of the present invention wherein the mounting surface comprises an imaging drum.

Referring to FIG. 1, there is illustrated an imaging apparatus 20 according to the present invention used to form images on a printing plate. Imaging apparatus 20 comprises a housing 22, plate supply 24, an imager 26 a motor 30 and an output area 34. In this embodiment, the mounting surface 27 comprises an imaging drum 28. Imaging drum 28 comprises a cylindrical shaped imaging drum 28 having an outer surface 38, which can, for example, be manufactured from a length of extruded aluminum tubing. Imaging drum 28 is adapted to secure printing plate 36 to outer surface 38 using vacuum or electrostatic attraction. Imaging drum 28 can also have clamps or fasteners (not shown) to secure printing plate 36 to outer surface 38.

To form an image on printing plate 36, printing plate 36 is transported to imaging drum 28, registered on outer surface 38 of imaging drum 28, and secured to outer surface 38 on imaging drum 28. During printing, motor 30 rotates imaging drum 28 to move printing plate 36 past imager 26. Imager 26 forms an image on printing surface 37 of printing plate 36. After an image has been formed on printing surface 37, printing plate 36 is transported to output area 34. It will be noted that printing plate 36 can be registered, secured to, and removed from imaging drum 28 manually or automatically.

Figure 2A:
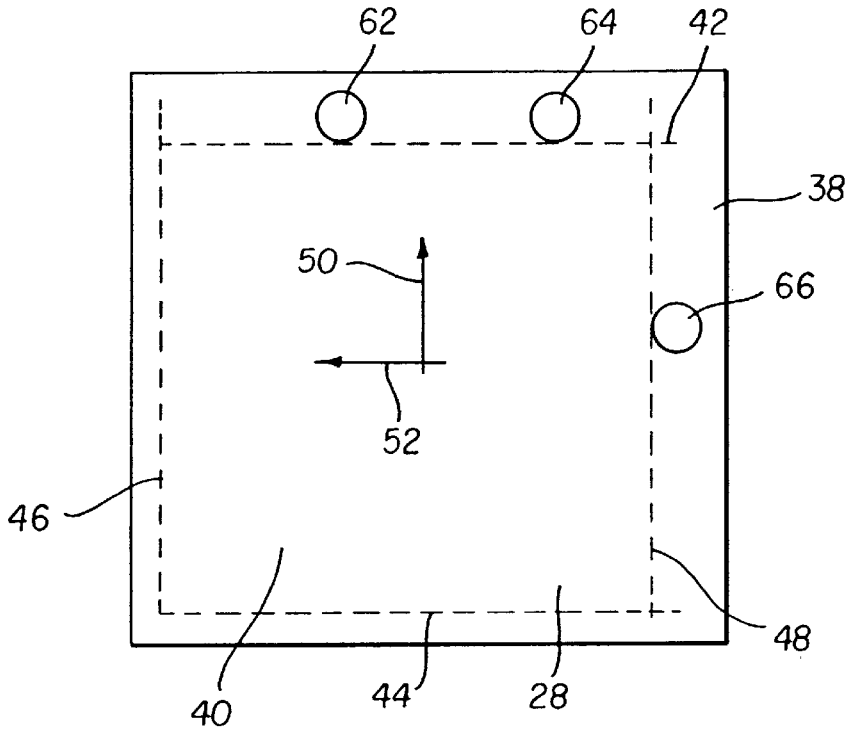
FIG. 2*a* shows a planar view of an imaging drum embodiment of the present invention.

FIG. 2*a* shows a planar view of the outer surface 38 of imaging drum 28 of the present invention. As can be seen from FIG. 2*a*, imaging drum 28 has an imaging area 40 defined by axial boundaries 42 and 44 and lateral boundaries 46 and 48. During imaging operations, imaging drum 28 is rotated along direction 50 while imager 26 (not shown) writes images generally along writing direction 52. Writing direction 52 is shown as being perpendicular to direction of rotation 50, however, it is not necessary to write an image using a path that is perpendicular to the direction of rotation 50.

Figure 2B:
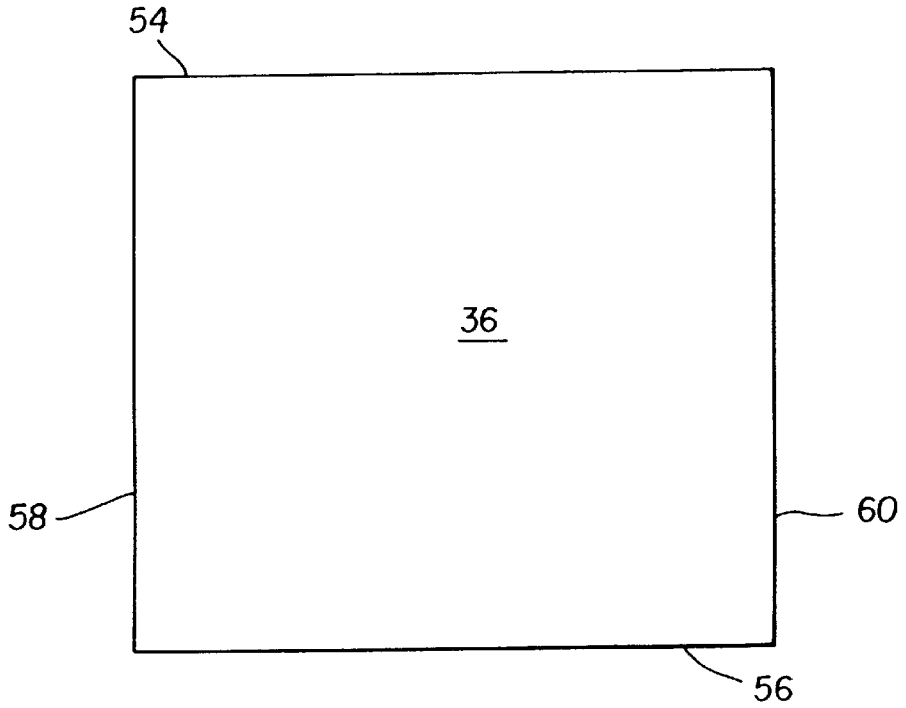
FIG. 2*b* shows a side cross section view of an imaging drum embodiment of the present invention.

FIG. 2*b* shows a planar view of a printing plate 36 of the type used in conjunction with the present invention. As shown in FIG. 2*b*, printing plate 36 has a leading axial edge 54, a trailing axial edge 56, a left lateral edge 58, and a right lateral edge 60. Printing plate 36 can be formed from an electrically conductive metallic substrate. However, printing plate 36 can also be formed from a plastic or other substrate having a conductive coating, exterior layer or wrapping.

Figure 3A:
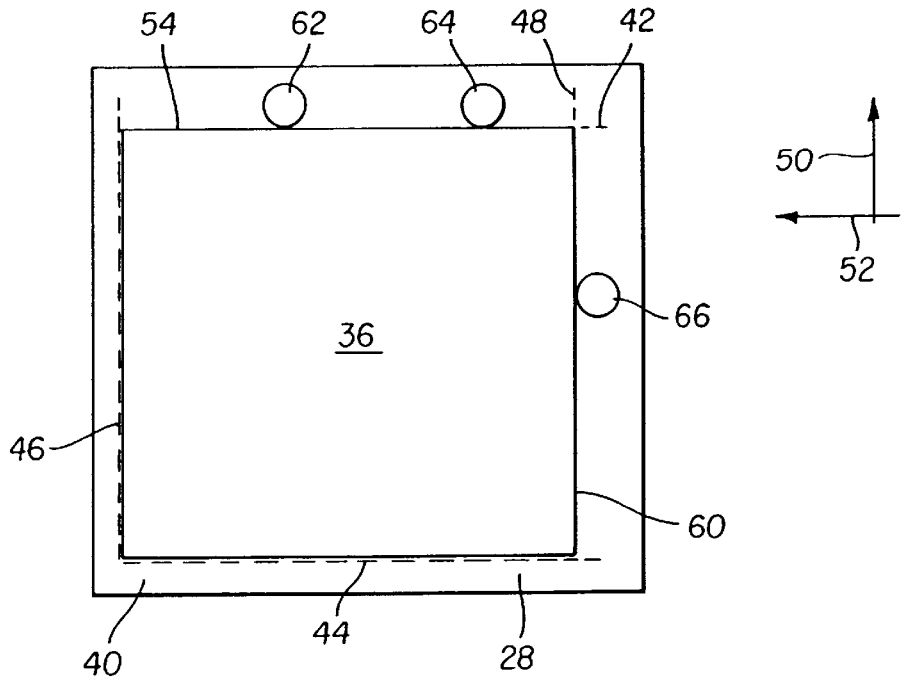
FIG. 3*a* shows a planar view of an imaging drum embodiment of the present invention with a printing plate in registration on an imaging drum.

FIG. 3*a* shows a planar view of an outer surface 38 of imaging drum 28 having a printing plate 36 in registration. As is shown in FIG. 3*a*, printing plate 36 is in registration when leading edge 54 is aligned with first axial boundary 42 and right lateral edge 60 is aligned with right lateral boundary 48.

Figure 3B:
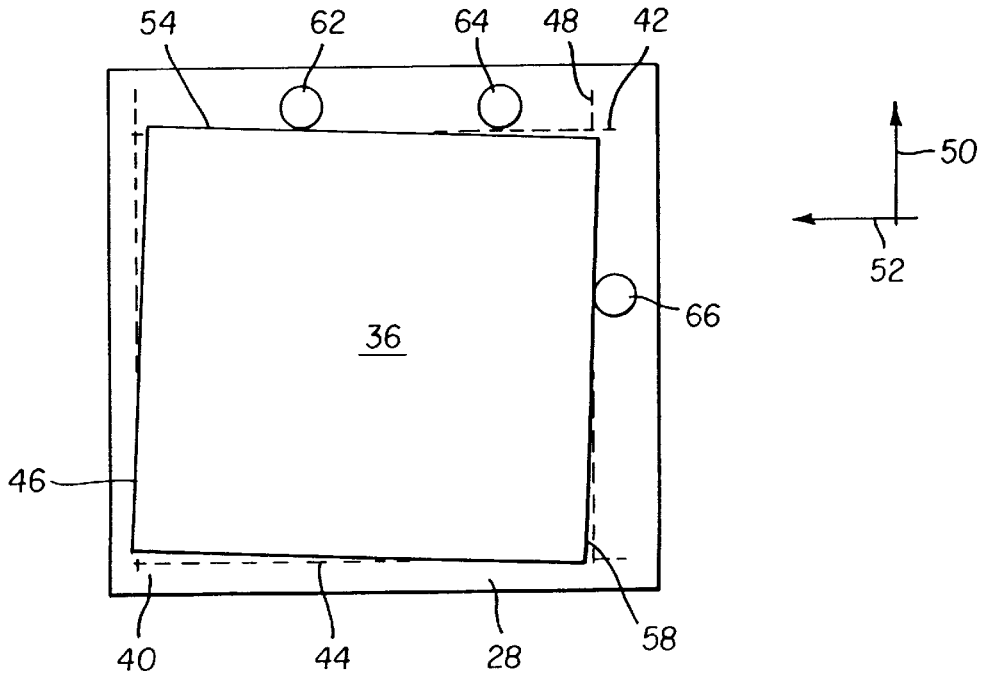
FIG. 3*b* shows a planar view of an imaging drum embodiment of the present invention having a printing plate mis-aligned.
Figure 3C:
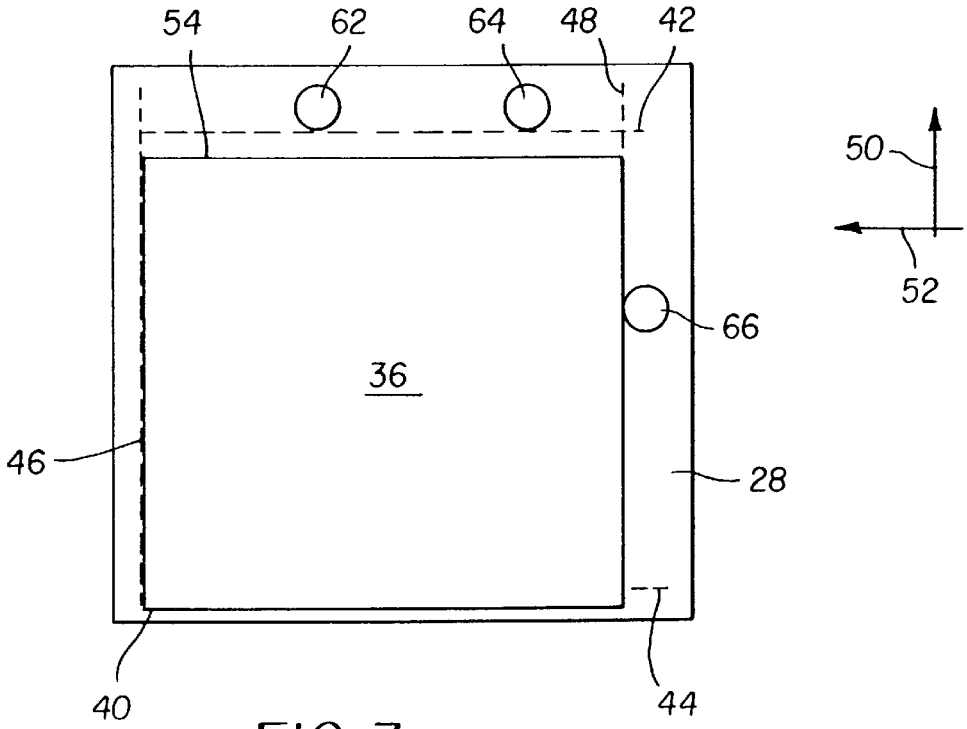
FIG. 3*c* shows a planar view of an imaging drum embodiment having a printing plate that is mis-positioned axially.
Figure 3D:
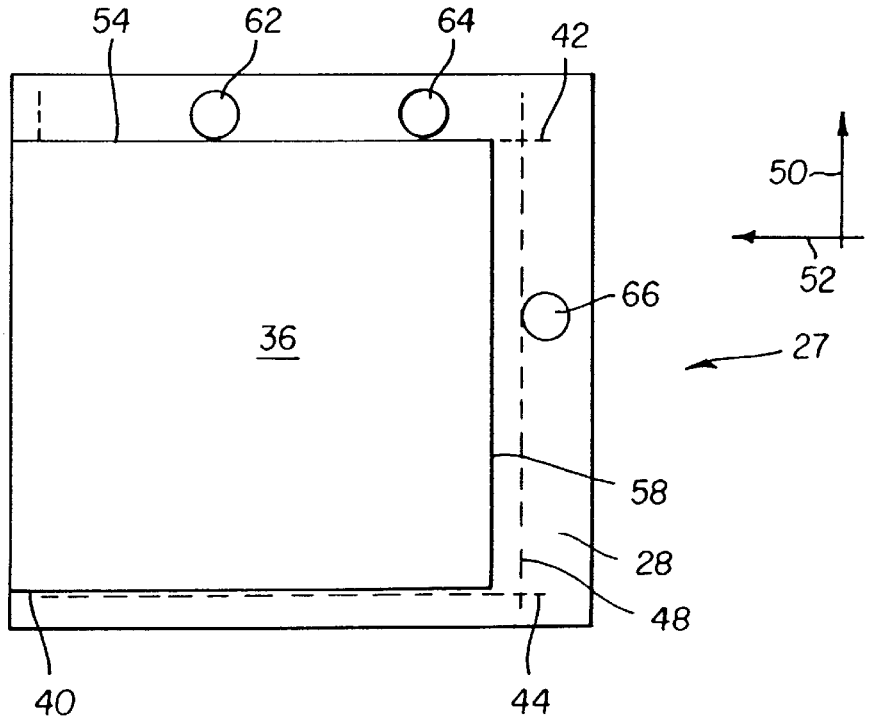
FIG. 3*d* shows a planar view of an imaging drum embodiment having a printing plate that is mis-positioned laterally.

For comparison, FIG. 3*b* shows a planar view of an imaging drum 28 having a printing plate 36 mounted on imaging drum 28 so that leading edge 54 is not aligned with first axial boundary 42. This is known as mis-registration. Another type of error known as mis-positioning can also occur. Mis-positioning can occur where printing plate 36 is not aligned with boundaries 42 and 48 as is shown in FIG. 3*c* and FIG. 3*d*. In FIG. 3*c*, printing plate 36 is mis-positioned because leading axial edge 54 is not aligned with axial boundary 42. In FIG. 3*d*, printing plate 36 is mis-positioned because right edge 60 is not aligned with lateral boundary 48.

In order to produce a quality image, it is essential to register printing plate 36 on outer surface 38 of imaging drum 28 during imaging. Even small errors in the placement of printing plate 36 on outer surface 38 can cause significant defects in the appearance of an image formed on plate 36. However, these errors can be difficult to detect during installation. Further, these errors can be created after printing plate 36 is positioned on imaging drum 28. For example, these errors can be introduced when printing plate 36 is clamped or otherwise secured to outer surface 38 of imaging drum 28 and can also be introduced as imaging drum 28 is rotated during imaging operations. Thus, it is necessary to ensure that printing plate 36 is in registration on outer surface 38 of imaging drum 28 throughout the imaging operation.

Figure 4A:
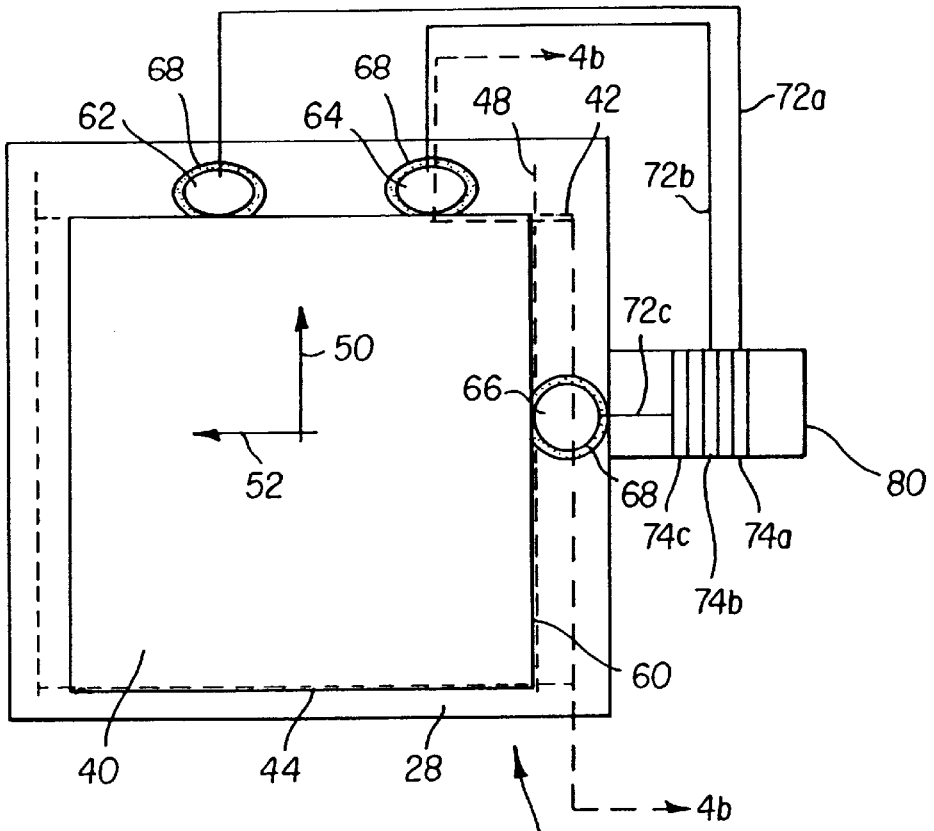
FIG. 4*a* shows a schematic view of an imaging drum embodiment with a printing plate attached.
Figure 4B:
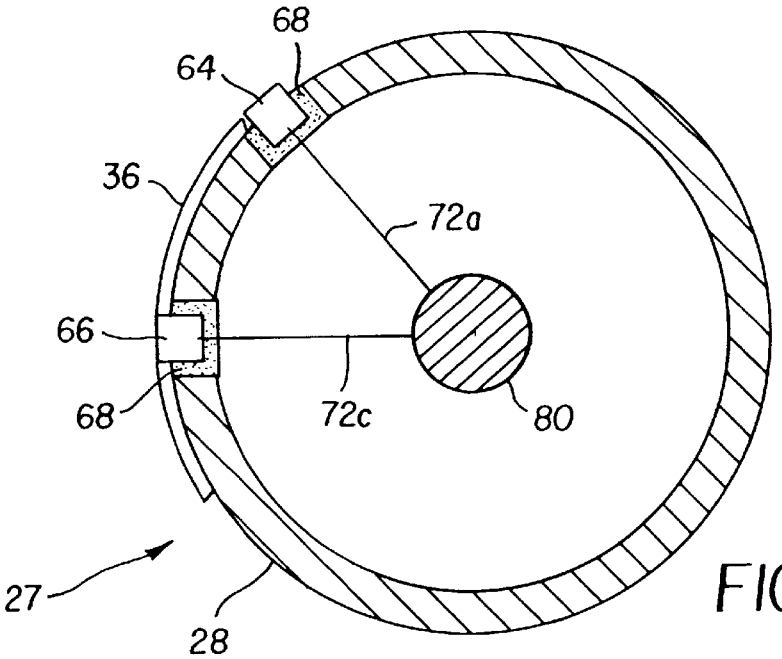
FIG. 4*b* shows a side cross-section view of an imaging drum embodiment with a printing plate attached.

FIGS. 4*a* and 4*b* show, respectively, a schematic cross-section side view of imaging drum 28 of the present invention with printing plate 36 secured to outer surface 38 of imaging drum 28. As is shown in FIG. 4*a*, imaging drum 28 has an outer surface 38 that includes a first electrical conductor 62, a second electrical conductor 64, and a third electrical conductor 66. First electrical conductor 62 and second electrical conductor 64 are positioned to form a first axial boundary 42 to engage leading longitudinal edge 54. Third electrical conductor 66 is positioned apart from first axial boundary 42 and is positioned to engage right lateral edge 60 of printing plate 36 and thus to define a right lateral boundary 48.

FIG. 4*b* shows that each of electrical conductors 62 (not shown), 64, and 66, protrudes radially outward from outer surface 38 to engage an edge of printing plate 36. This permits printing plate 36 to be placed in registration by positioning printing plate 36 in a position where leading edge 54 contacts first electrical conductor 62 and second electrical conductor 64 and positioning right lateral edge 60 in contact with third electrical conductor 66. When printing plate 36 is in contact with each of conductors 62, 64, and 66, printing plate 36 is in registration on imaging drum 28.

Because even a small separation between printing plate 36 and electrical conductors 62, 64 and 66 can cause significant imaging errors, the imaging drum 28 of the present invention is adapted to electronically detect when printing plate 36 is in contact with each of conductors 62, 64 and 66. In this regard, electrical conductors 62, 64 and 66 are surrounded by electrical insulating material 68. Electrical insulating material 68 electrically isolates each of electrical conductors 62, 64, and 66 from outer surface 38 and from each other.

In the illustrated embodiment of the present invention, when the edges of printing plate 36 contacts all of the electrical conductors 62, 64, and 66, printing plate 36 creates a short between electrical conductors 62, 64 and 66. However, if printing plate 36 fails to directly contact each of electrical conductors 62, 64 and 66, then no short is created. Thus, even a small electrical gap between printing plate 36 and conductors 62, 64 and 66 will prevent the formation of the short. Accordingly, by using the imaging drum 28 of the illustrated embodiment of the present invention, it is possible to determine whether printing plate 36 is in registration simply by testing whether a short exists between each of the conductors 62, 64 and 66. The present invention thus uses printing plate 36 as an AND gate providing a selected electrical output—a short between the conductors 62, 64, and 66—only when printing plate 36 is positioned in contact with each of conductors 62, 64 and 66.

A number of different ways to detect the existence of the short are known. In imaging apparatus 20 of the present invention, an electrical short detection circuit (not shown) is connected to each of the conductors 62, 64 and 66. The electrical short detection circuit generates an output signal that is indicative of whether a short exists. In the embodiment of FIGS. 4*a* and 4*b* the imaging drum 28 is adapted to permit an electrical short detection circuit (not shown) that is external to imaging drum 28 to detect the electrical short. In this embodiment, each of the electrical conductors 62, 64 and 66 are electrically connected by way of transmission lines 72*a*, 72*b* and 72*c* to contacts 74*a*, 74*b* and 74*c*. Contacts 74*a*, 74*b*, and 74*c* are positioned on an exterior surface of imaging drum 28 including but not limited to outer surface 38, end caps (not shown) of imaging drum 28 or a drum central shaft 80 as is shown in FIG. 4*b*.

Figure 5A:
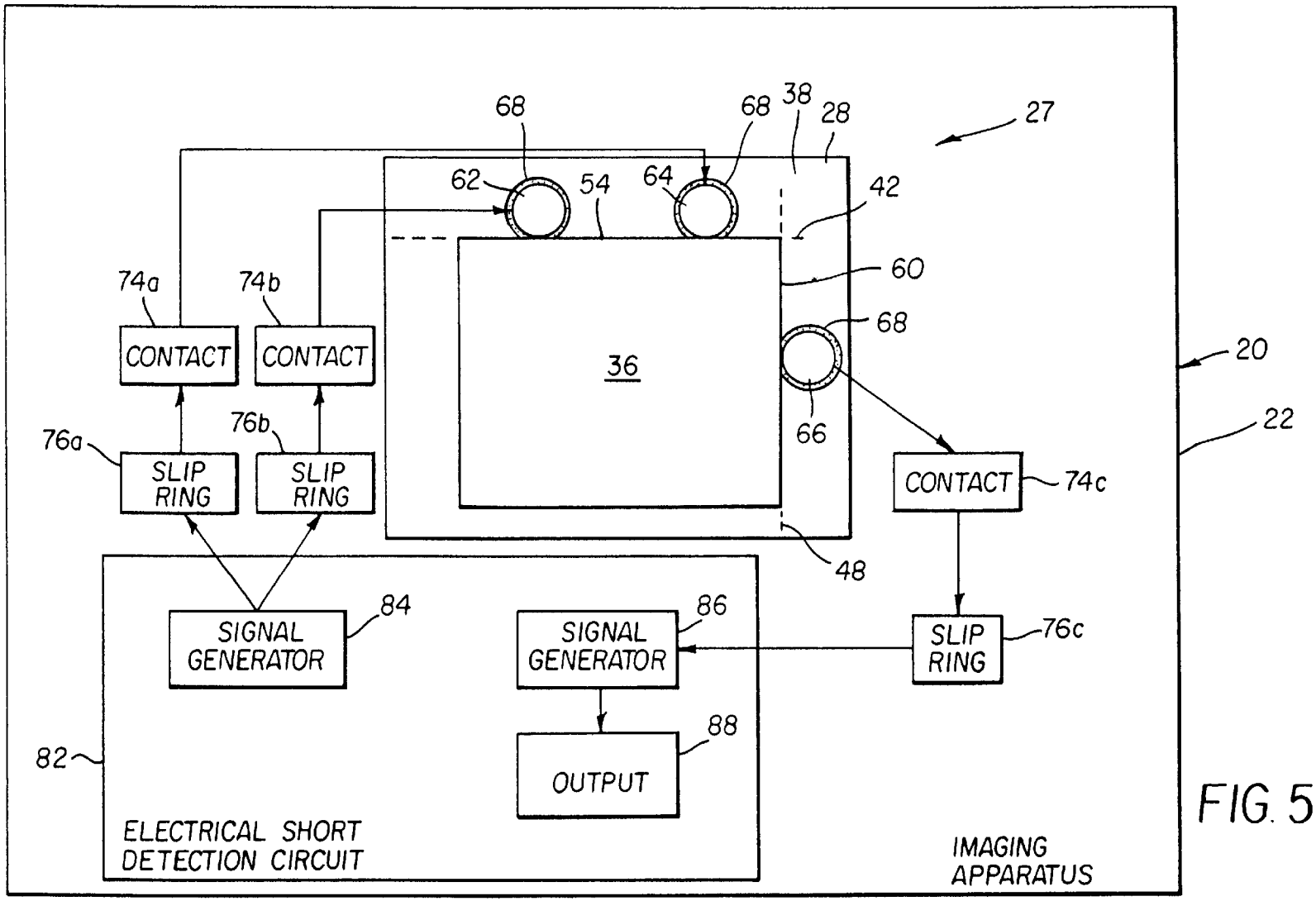
FIG. 5*a* shows a schematic diagram of an imaging drum of the present invention showing the electrical signal path created when a printing plate is in registration.

FIG. 5*a* shows a schematic diagram of an imaging apparatus 20 of the present invention showing the electrical signal path created between connectors 62, 64, and 66, plate 36 and electrical short detection circuit 82 when imaging drum 28 is installed in imaging apparatus 20. When imaging drum 28 is so positioned, slip rings 76*a*, 76*b* and 76*c* engage contacts 74*a*, 74*b* and 74*c*. This forms an electrical short detection connection that permits electrical circuit 82 to detect electrical conditions at electrical conductors 62, 64 and 66 before, during, and after rotation of the imaging drum 28. Electrical short detection circuit 82 is adapted to determine when a short exists between each of conductors 62, 64 and 66. Electrical circuit 82 generates an output that indicates whether the short exists.

FIG. 5*a* shows an embodiment of the present invention wherein electrical short detection circuit 82 comprises a signal generator 84 that generates an electrical signal at conductors 62 and 64. In this embodiment, electrical short detection circuit 82 also comprises a signal detector 86 that senses electrical signals at conductor 66. As is shown in FIG. 5*a*, when printing plate 36 is in registration on outer surface 38, printing plate 36 contacts conductors 62, 64 and 66. This defines a path for the electrical signals from conductors 62 and 64 to flow to conductor 66. When detector 86 receives signals from both of conductors 62 and 64, it generates a signal activating an output 88 indicating that printing plate 36 is in registration. Output 88 can comprise a display, an audible warning or other warning. Output 88 can also comprise an input to a controller (not shown) for the imaging apparatus 20.

Figure 5B:
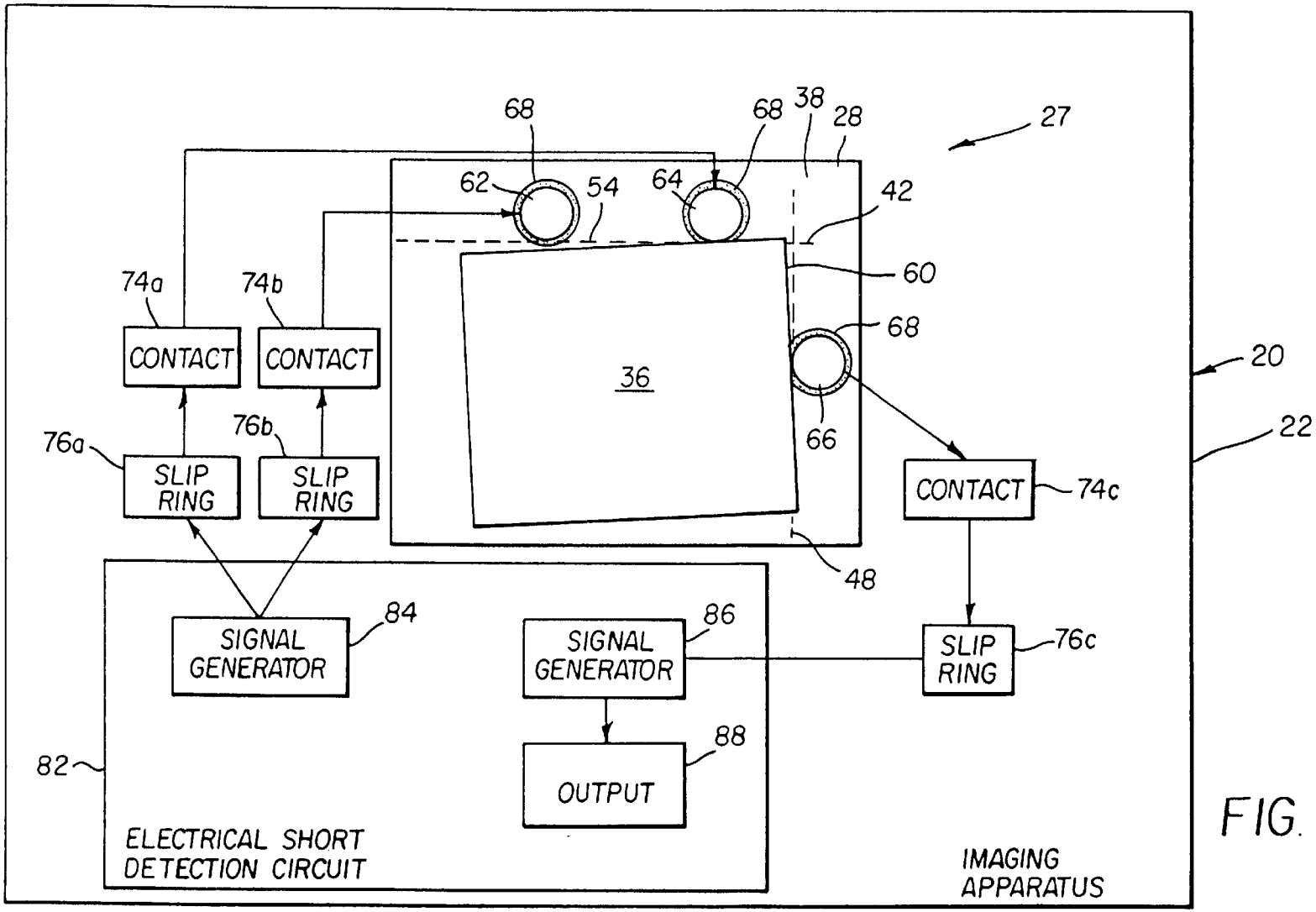
FIG. 5*b* shows a schematic diagram of an imaging drum of the present invention showing the electrical signal path created when a printing plate is mis-aligned.

FIG. 5*b* shows the operation of the embodiment of FIG. 5*a* wherein printing plate 36 is mounted on imaging drum 28 so that leading edge 54 is not aligned with first axial boundary 42. In this situation, only the signal from conductor 64 is conveyed to conductor 66. Accordingly, signal detector 86 only detects the signal from conductor 64 and activates an output to indicate that printing plate 36 is not in registration. Signal detector 86 can optionally be adapted to identify the conductor from which a signal is not received and to cause output 88 to identify this conductor.

Figure 5C:
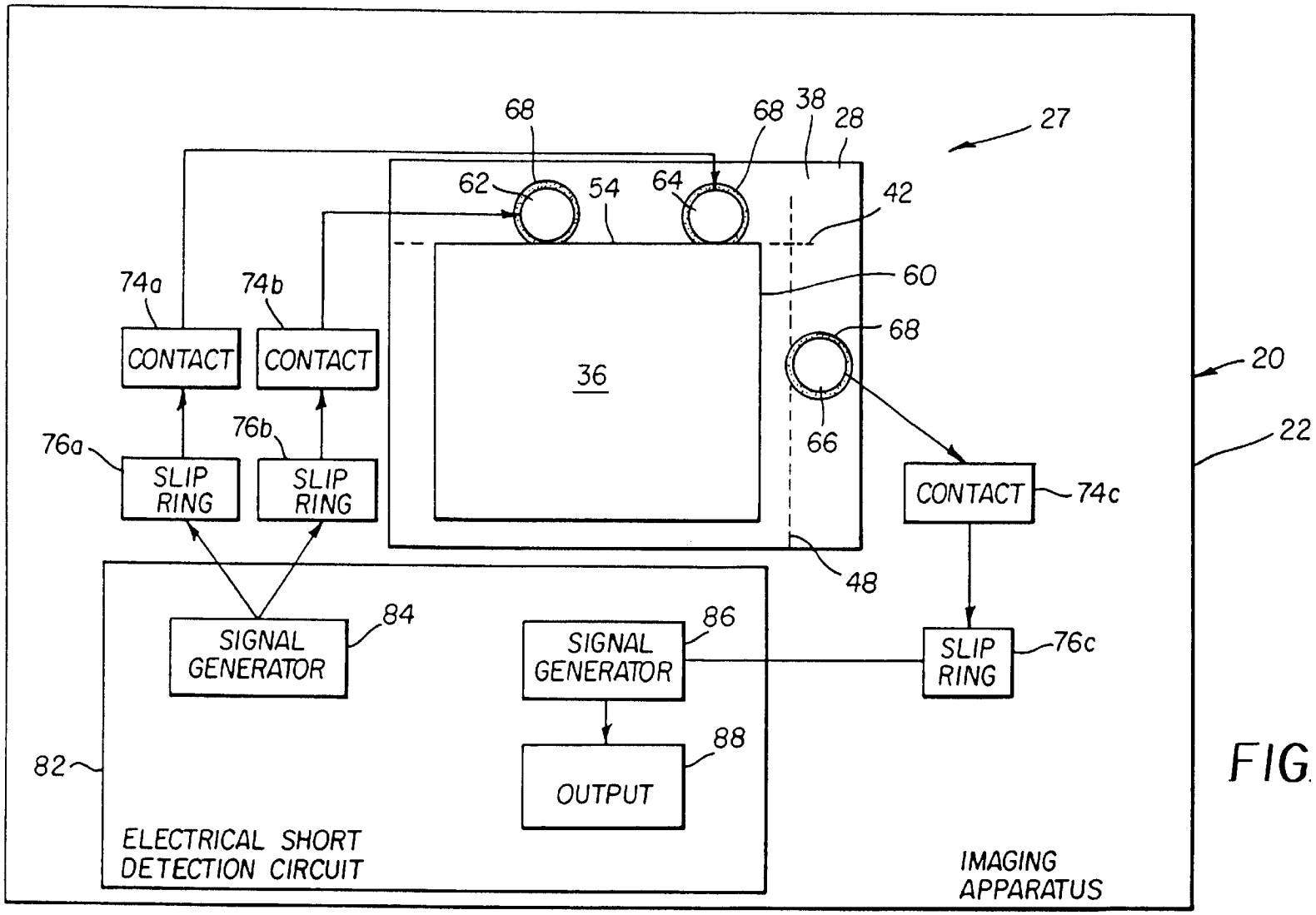
FIG. 5*c* shows a schematic diagram of an imaging drum of the present invention showing the electrical signal path created when a printing plate is mis-positioned laterally.
Figure 5D:
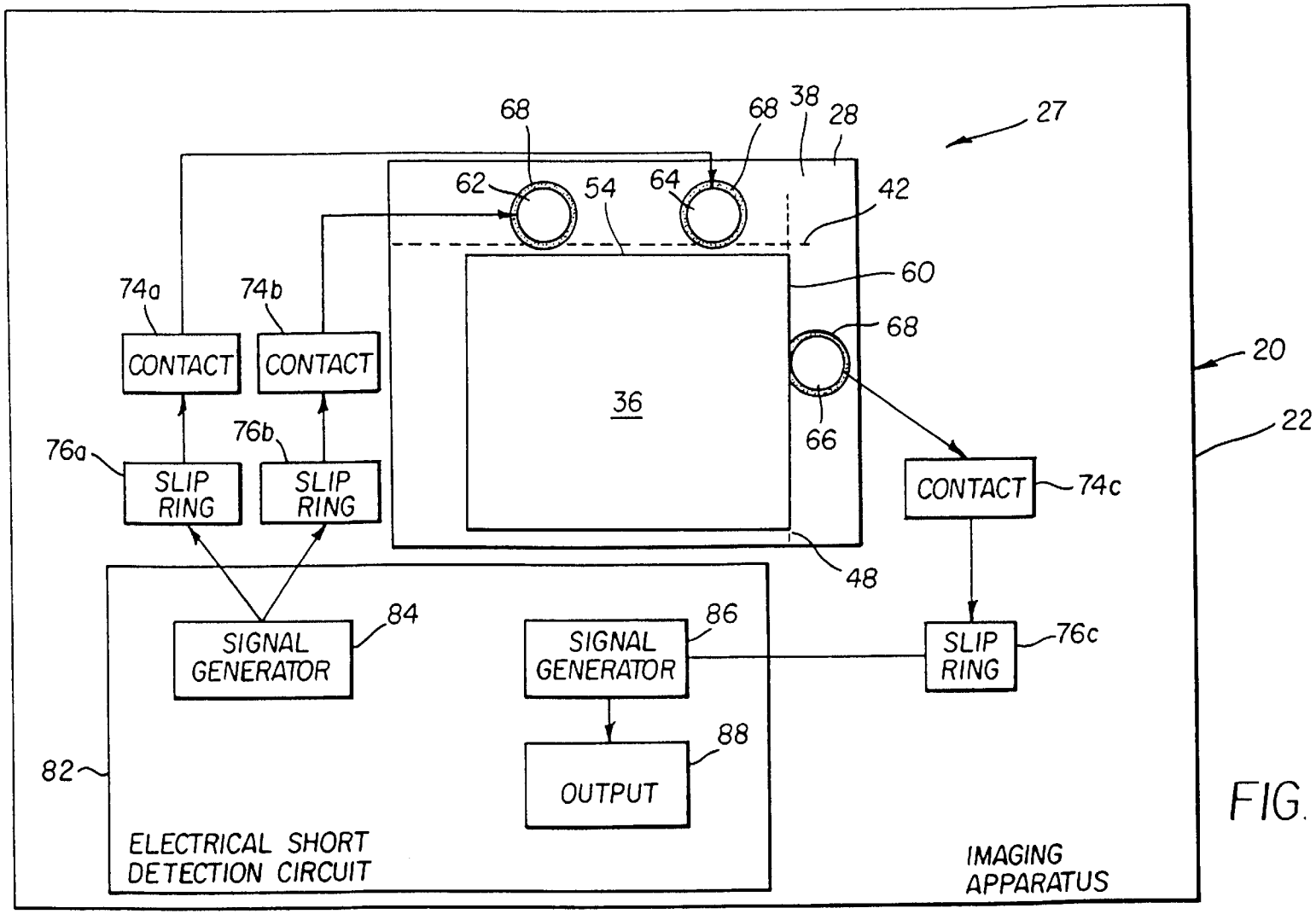
FIG. 5*d* shows a schematic diagram of an imaging drum of the present invention showing the electrical signal path created when a printing plate is mis-positioned axially.

FIG. 5*c* shows the operation of the embodiment of FIG. 5*a*, wherein printing plate 36 is mounted on imaging drum 28 so that right edge 58 is not aligned with right lateral boundary 48. In this situation, no signals are received by conductor 66 and detector 86 generates a signal causing output 88 to indicate that printing plate 36 is not in registration. Similarly, FIG. 5*d* shows the operation of the embodiment of FIG. 5*a* wherein printing plate 36 is mounted on imaging drum 28 so that leading axial edge 54 is not aligned with axial boundary 42. Here too, detector 86 does not receive any signals from connectors 62 or 64. Because of this, detector 86 generates a signal causing output 88 to indicate that printing plate 36 is not in registration.

The present invention can be configured to work with electrical signals in many forms. For example, signal generator 84 and signal detector 86 can be adapted to generate and detect, respectively, steady state signals, binary signals and/or phase, amplitude or frequency modulated signals. In an alternative embodiment of the present invention, signal generator 84 is adapted to provide unique electrical signals at conductors 62 and 64. In this embodiment, signal detector 86 is adapted to identify which of conductors 62 and 64 is not in contact with printing plate 36 by examination of the signals that are received at conductor 66. For example, signal generator 84 can generate a first voltage signal having a frequency of 20 Hz at conductor 62 and a second voltage signal having a frequency of 25 Hz at conductor 64. In this example, signal detector 86 can be adapted to determine that printing plate 36 is in registration when both signals are detected, that printing plate 36 is not in contact with conductor 62 when only a 20 Hz signal is received and that printing plate 36 is not in contact with conductor 64 when only a 25 Hz signal is received.

Figure 6A:
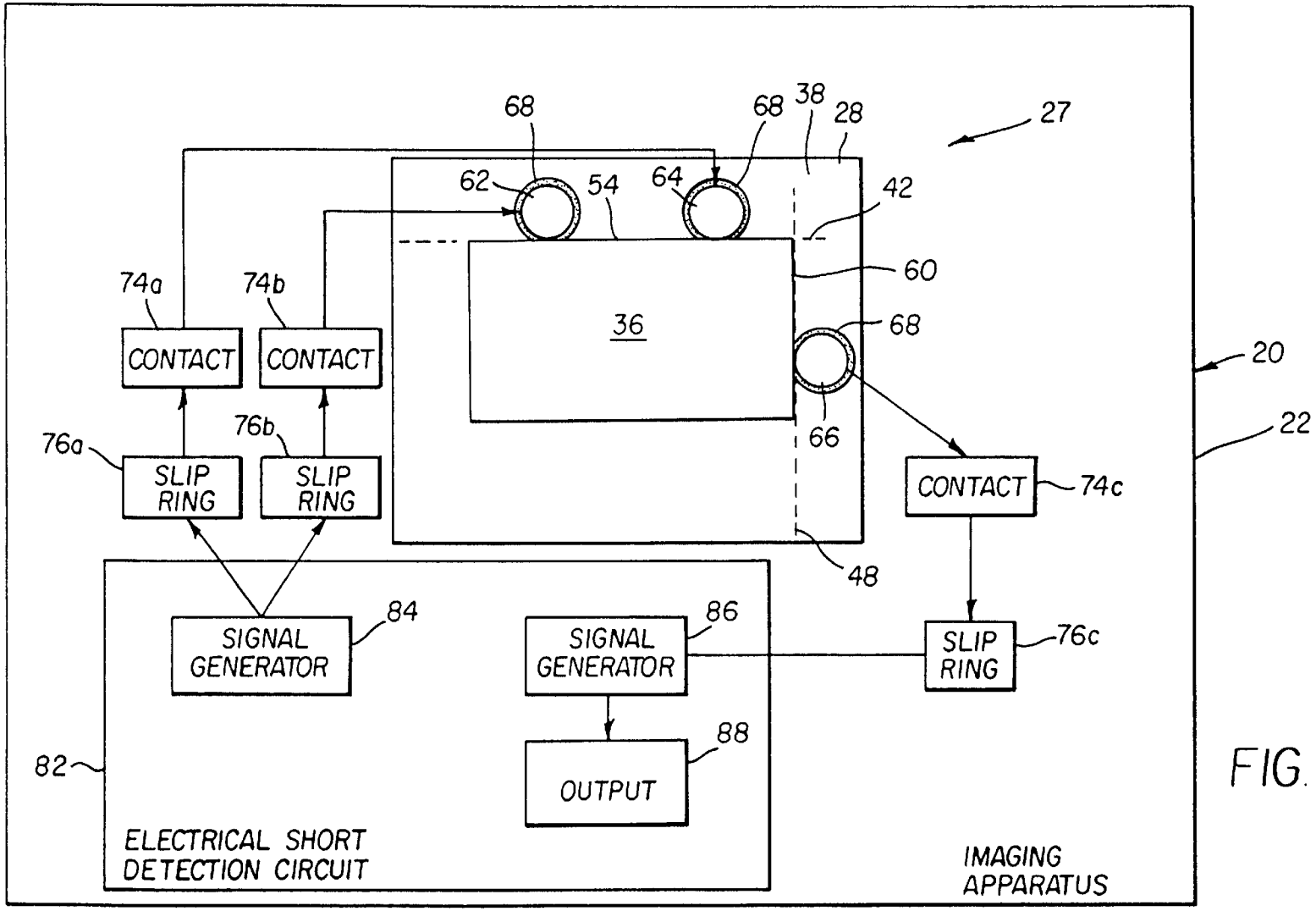
FIG. 6*a* shows a schematic diagram of an imaging drum of the present invention showing the electrical signal path created when a non-standard sized printing plate is in registration.
Figure 6B:
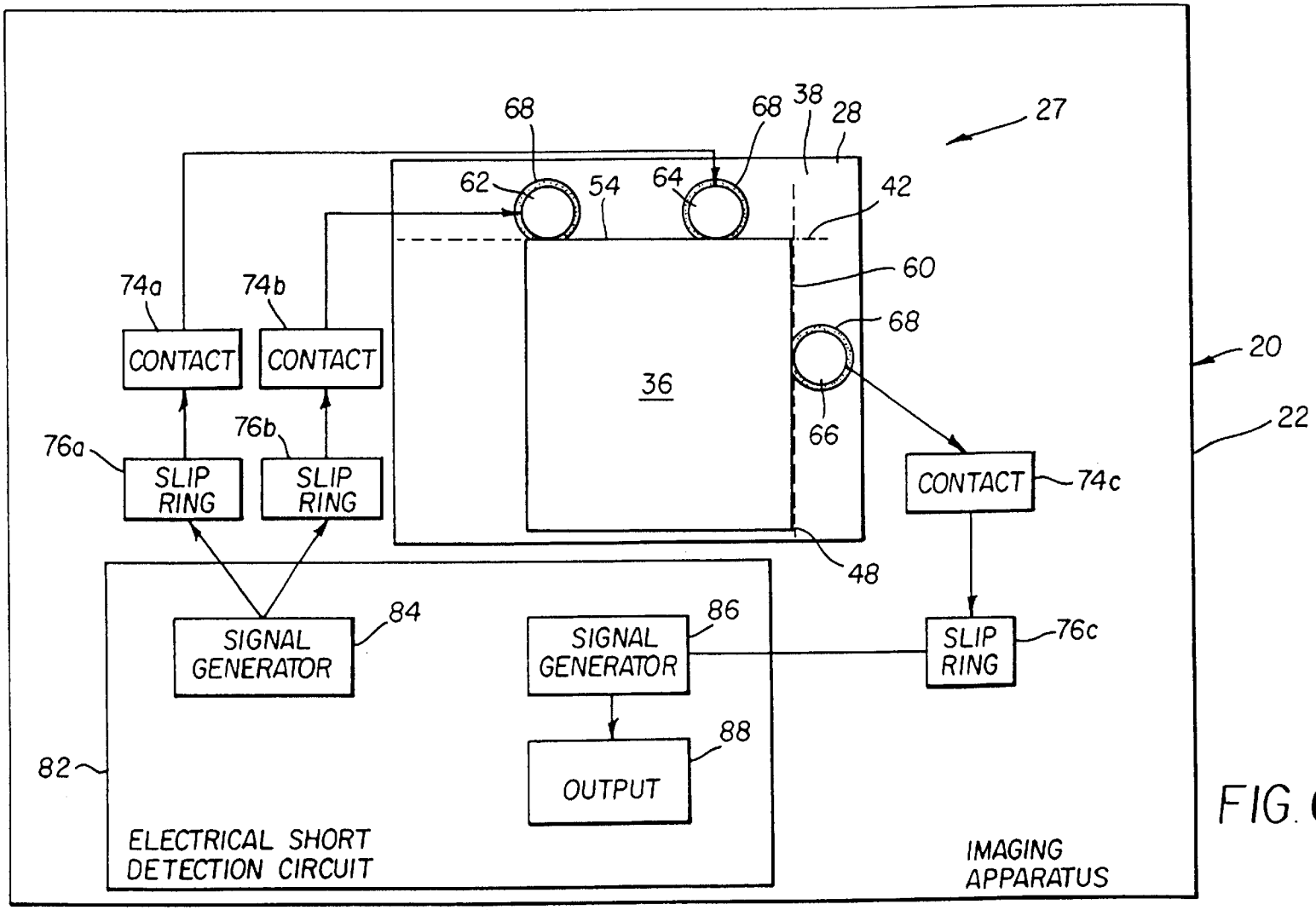
FIG. 6*b* shows a schematic diagram of an imaging drum of the present invention showing the electrical signal path created when a second non-standard sized printing plate is in registration.

As is shown in FIGS. 6*a* and 6*b* the present invention can easily accommodate printing plates 36 having various sizes while still ensuring that leading edge 54 and right lateral edge 60 are aligned and that printing plate 36 is in registration.

Figure 7:
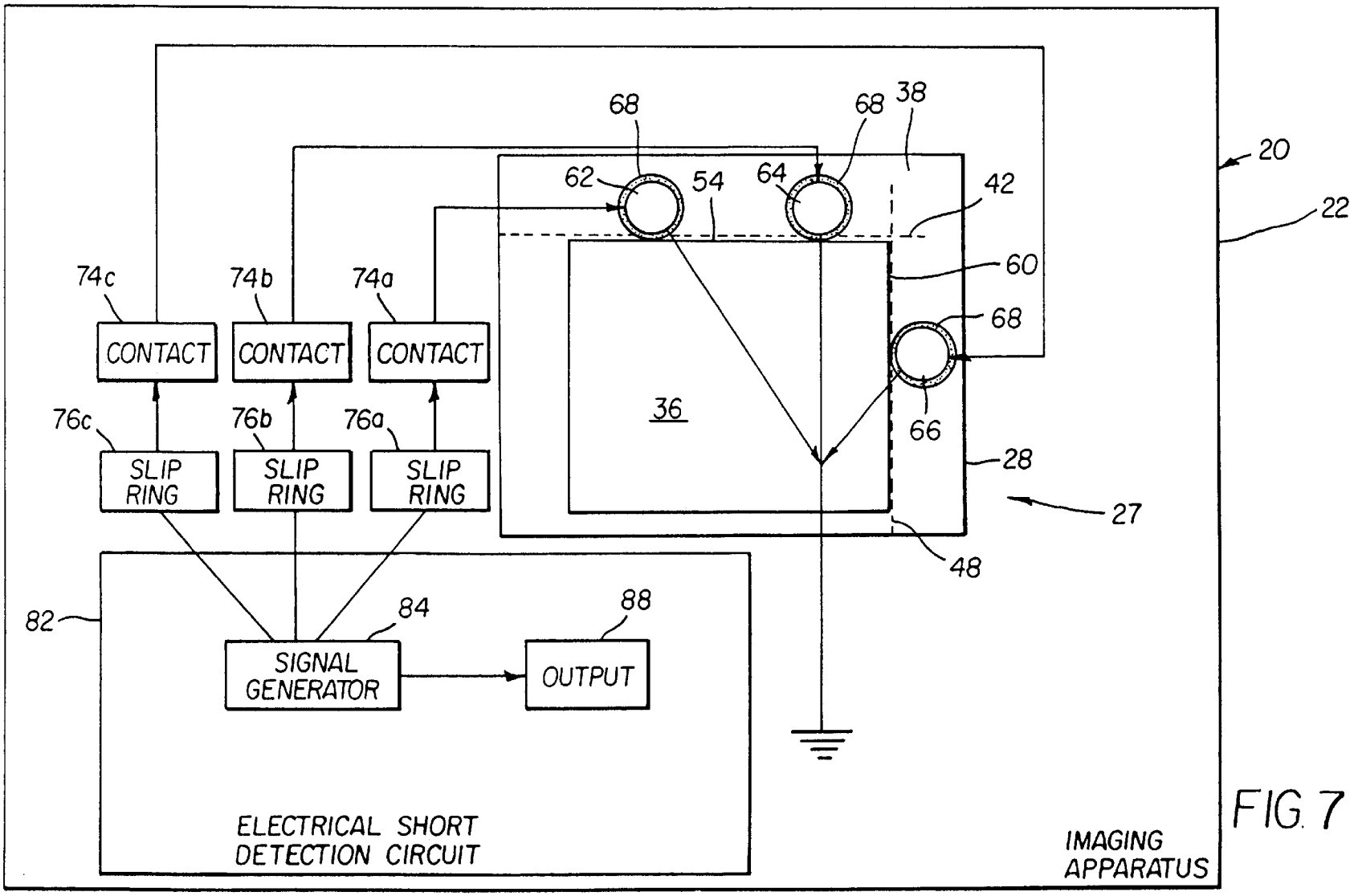
FIG. 7 shows a schematic diagram of an imaging drum of the preset invention showing an alternative electrical path used in an alternative embodiment of the present invention.

FIG. 7 shows an alternative embodiment of the present invention. In this embodiment, signal generator 84 generates electrical signals for each of conductors 62, 64, and 66. In this embodiment printing plate 36 is grounded Thus, as printing plate 36 is brought into contact with each of conductors 62, 64, and 66, the load on signal generator 84 increases. In this embodiment, signal generator 84 is adapted to detect when the load reaches a threshold. When the load reaches the threshold, signal generator 86 generates an output signal indicating that printing plate 36 is in registration.

Figure 8:
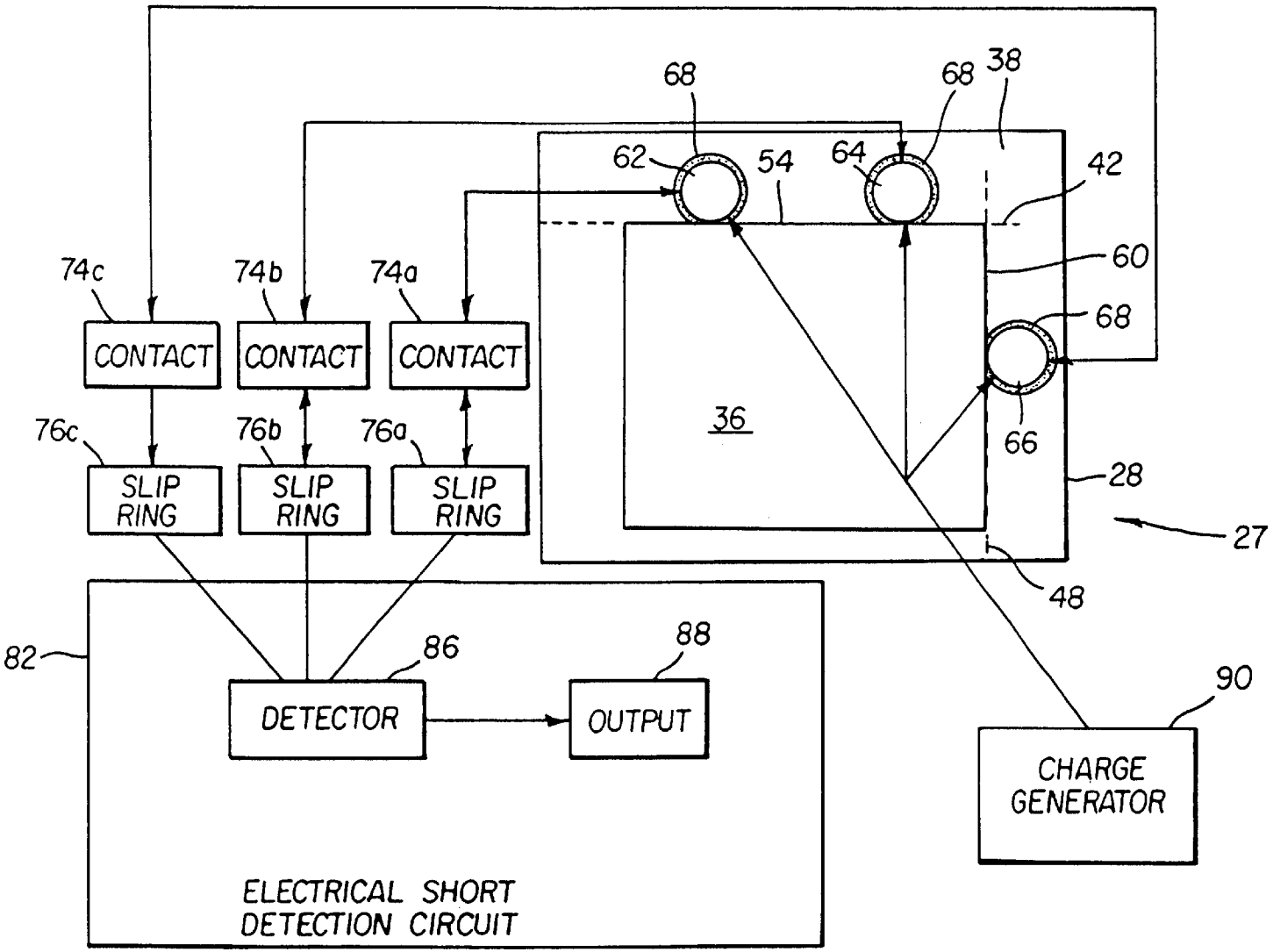
FIG. 8 shows a schematic diagram of an imaging drum of the preset invention showing another alternative electrical path used in an alternative embodiment of the present invention.

In another embodiment of the present invention shown in FIG. 8, drum 28 is adapted to electrostatically attract printing plate 36 to outer surface 68. In this embodiment, charge generator 90 generates an electrostatic charge at outer surface 38 of imaging drum 28. This charge acts on printing plate 36 when printing plate 36 is positioned on the outer surface 38 of drum 28. Conductors 62, 64, and 66, however, are insulated from this charge by insulating material 68. Conductors 62, 64, and 66 therefore are only exposed to electrostatic charge on outer surface 68 by way of contact with printing plate 36. In this embodiment, signal detector 86 is connected to each of conductors 62, 64, and 66 and detects the presence of electrostatic charge from printing plate 36 and each of the conductors. When electrostatic charge is detected at each of conductors 62, 64, and 66, detector 86 generates a signal causing output 88 to indicate that printing plate 36 is in registration.

Figure 9A:
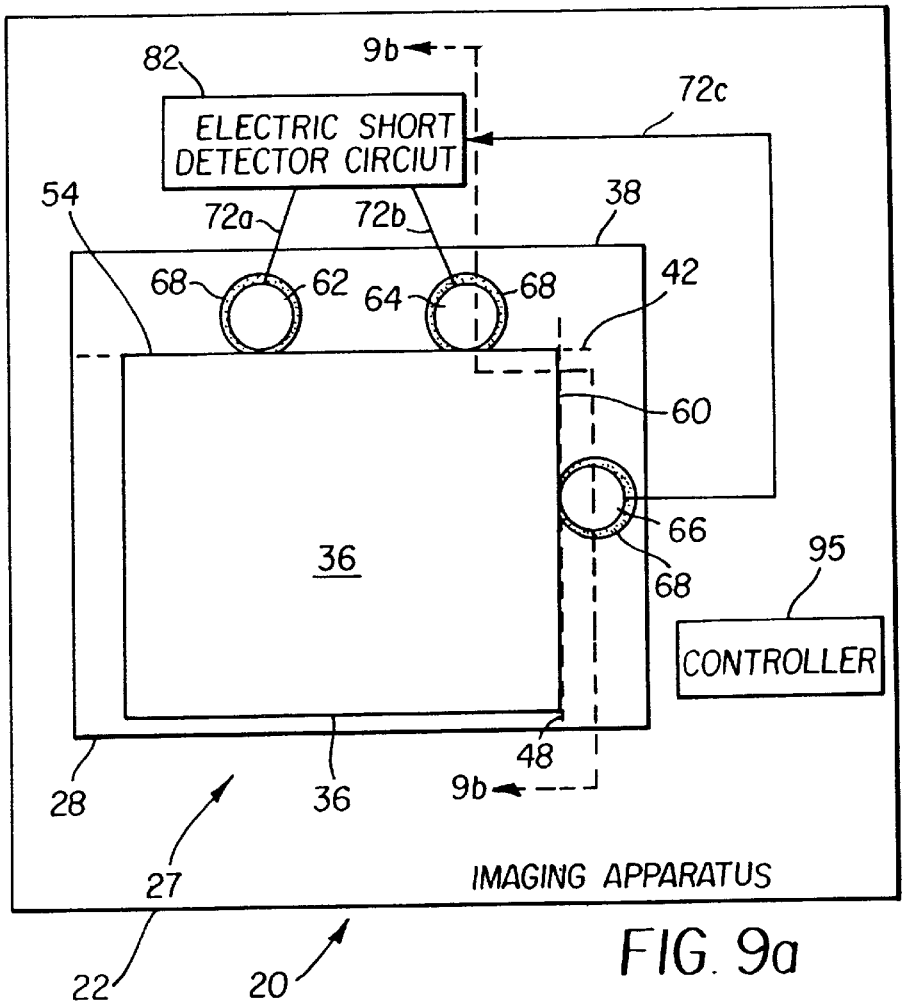
FIG. 9*a* shows a schematic diagram of an imaging apparatus wherein a detection circuit is incorporated into the imaging drum.
Figure 9B:
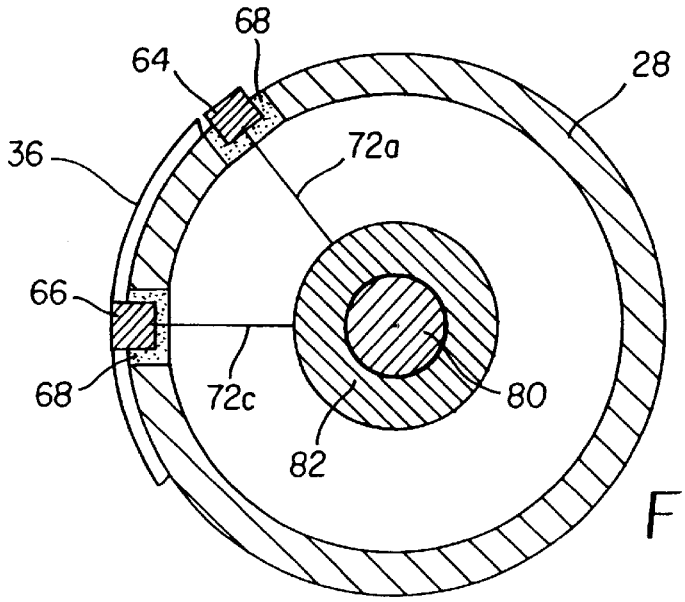
FIG. 9*b* shows a cross-section view of an imaging drum of the embodiment of FIG. 9*a* wherein the detection circuit is incorporated into the imaging drum.

Although the present invention has been described as having an electric short detector circuit 82 that is external to imaging drum 28, it is possible to incorporate electric short detection circuit 82 into the imaging drum 28. FIGS. 9*a* and 9*b* show an imaging drum 28 of the present invention incorporating an electrical short detection circuit 82. In this embodiment, electrical short detection circuit 82 is connected to each of conductors 62, 64 and 66 and detects the existence of an electrical short between these conductors. Where an electrical short is detected between conductors 62, 64, and 66, electrical short detection circuit 82 generates an output to indicate that printing plate 36 is in registration. Electrical short detection circuit 82 can also generate an output to indicate when printing plate 36 is not in registration on outer surface 38. This output may be in the form of an electrical signal, an optical signal, audible signal or a radio frequency signal. The electrical signal, optical signal, audible signal, or radio frequency signal from imaging drum 28 can be received by controller 95 of imaging apparatus 20 and used to prevent or to interrupt imaging operations until printing plate 36 can be placed in registration on outer surface 38.

Figure 10A:
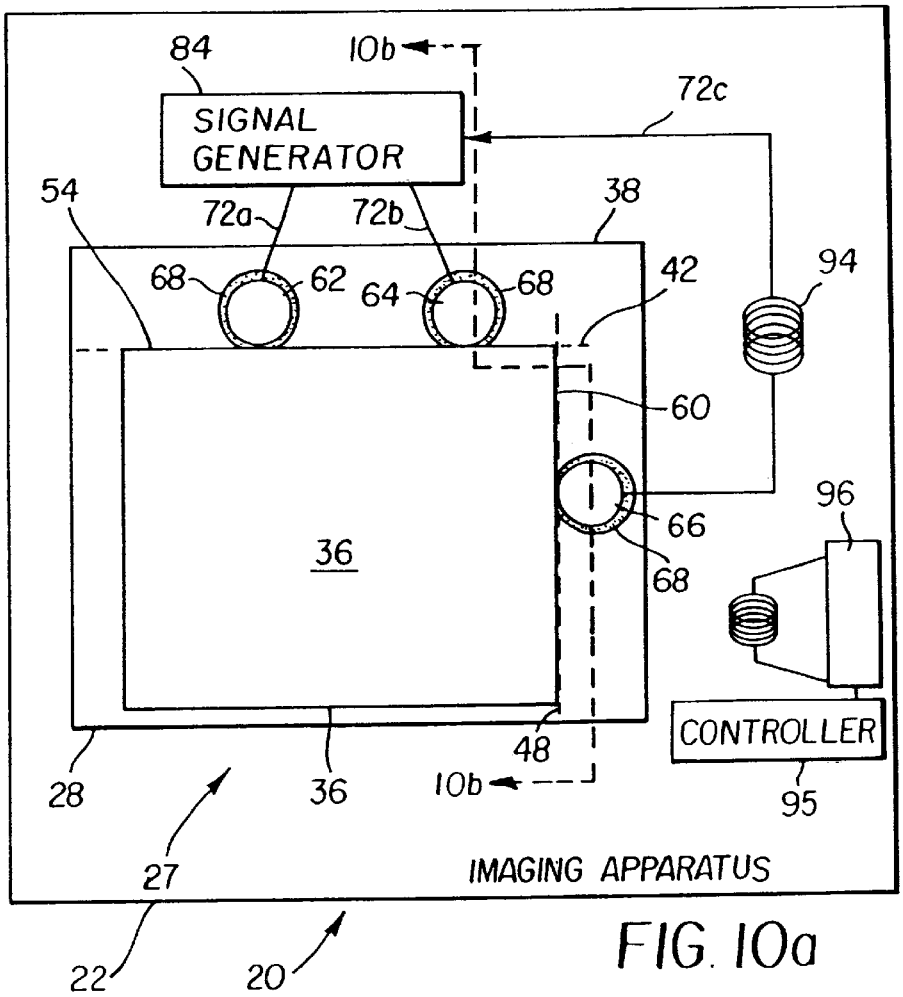
FIG. 10*a* shows an imaging apparatus wherein the imaging drum is adapted to provide a radio frequency signal indicating that a printing plate is in registration.
Figure 10B:
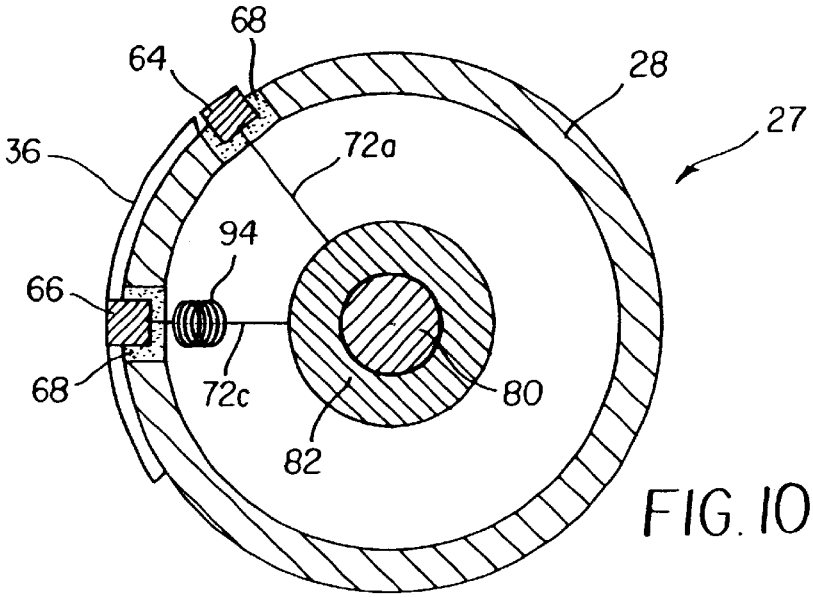
FIG. 10*b* shows a cross-section view of an imaging drum of the embodiment of FIG. 10*a* wherein the detection circuit is incorporated into the imaging drum.

In one embodiment shown in FIGS. 10*a* and 10*b*, radio frequency communications are used to indicate the presence or absence of an electric charge at conductors 62, 64, and 66. In this embodiment, an electric signal is provided at each of conductors 62 and 64. Conductor 66 is connected by way of a tuned coil 94 to a ground. When printing plate 36 is positioned in contact with each of conductors 62, 64 and 66, the electric signal at conductors 62 and 64 flows to conductor 66 and from there through tuned coil 94 to ground. This causes a radio frequency signal to emit from the tuned coil. A radio frequency detector 96 positioned outside of imaging drum 28 detects the radio frequency signal and analyzes the signal to ensure that the radio frequency signal transmitted by tuned coil 94 is indicative of a signal that would be transmitted by a tuned coil 94 that receives signals from both conductors 62 and 64. The radio frequency signal from tuned coil 94 can be received by controller 95 of imaging apparatus 20 and used to prevent or to interrupt imaging operations until printing plate 36 can be placed in registration on outer surface 38.

Figure 11A:
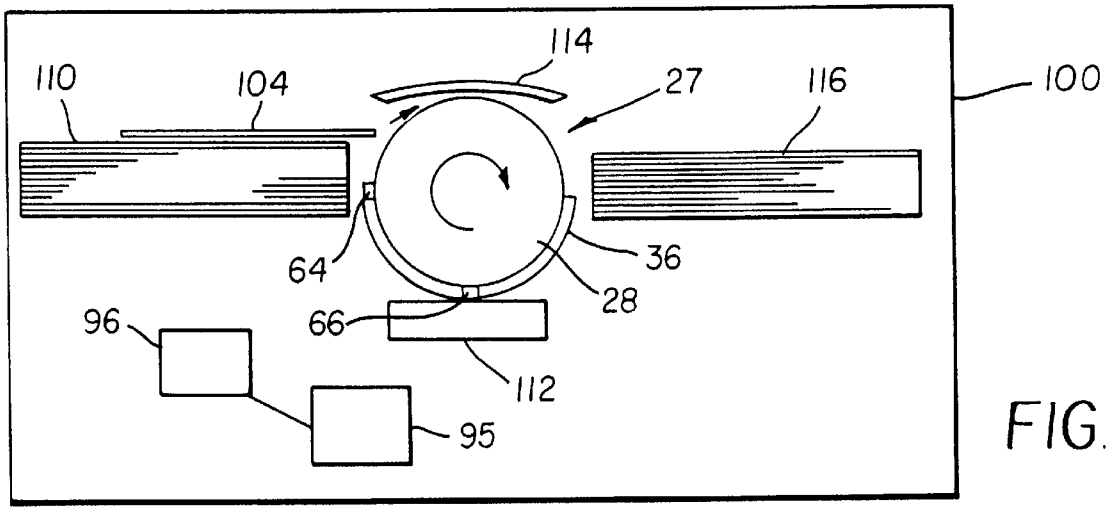
FIG. 11*a* shows a schematic diagram of a contact printer using a drum of the present invention.
Figure 11B:
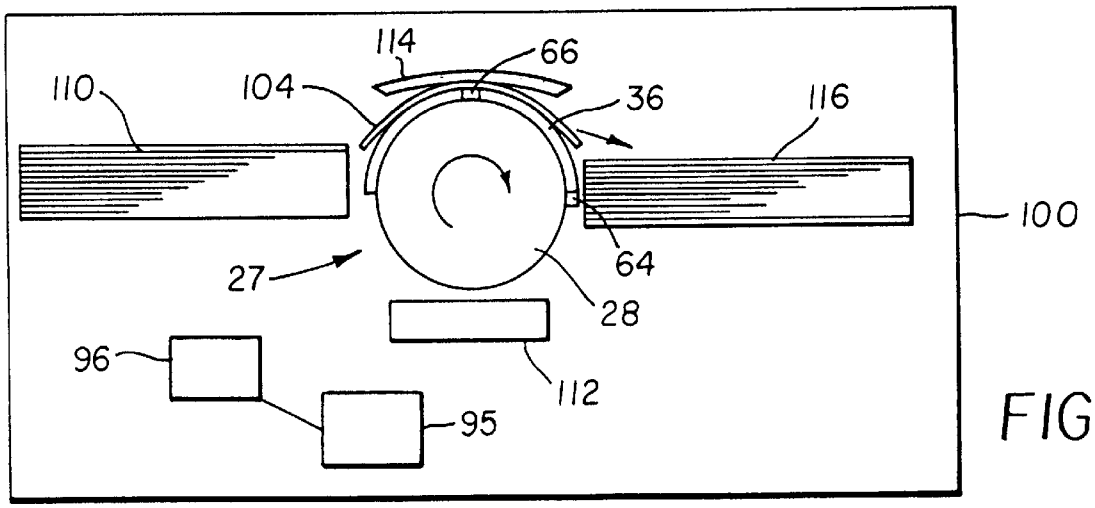
FIG. 11*b* shows a schematic diagram of a contact printer using a drum of the present invention.

The present invention has generally been described as being used in conjunction with an imaging apparatus 20 for forming an image on a printing plate 36. It will be appreciated however that the imaging apparatus 20 of the present invention can also comprise a contact printer 100 having amounting surface 27 adapted for contact printing using a printing plate. One embodiment of a printing press is shown in schematic form in FIG. 11. As is shown in FIG. 11, contact printer 100 comprises an imaging drum 28 having a printing plate 36 fixed thereto, a source of receiver media 110, a donor material applicator 112, a contact sleeve 114 and an output area 116. In this embodiment printing plate 36 is positioned on the outside surface 38 of imaging drum 28. Motor 30 rotates imaging drum 28, bringing printing plate 36 into contact with donor material applicator 112. This applies a donor material such as an ink or thermal media to the printing plate 36. As motor 30 continues to turn imaging drum 28, receiver media 104 is drawn onto printing plate 36. Receiver media 104 is then compressed between imaging drum 28 and contact sleeve 114 in order to cause ink or other donor material to adhere to receiver media. Receiver media 104 is then removed and stored in output area 116. In the embodiment shown, imaging drum 28 is adapted to transmit a radio frequency signal that indicates whether printing plate 36 is in registration. This radio frequency signal is received by radio frequency detector 96 which provides a signal to controller 95.

Figure 12:
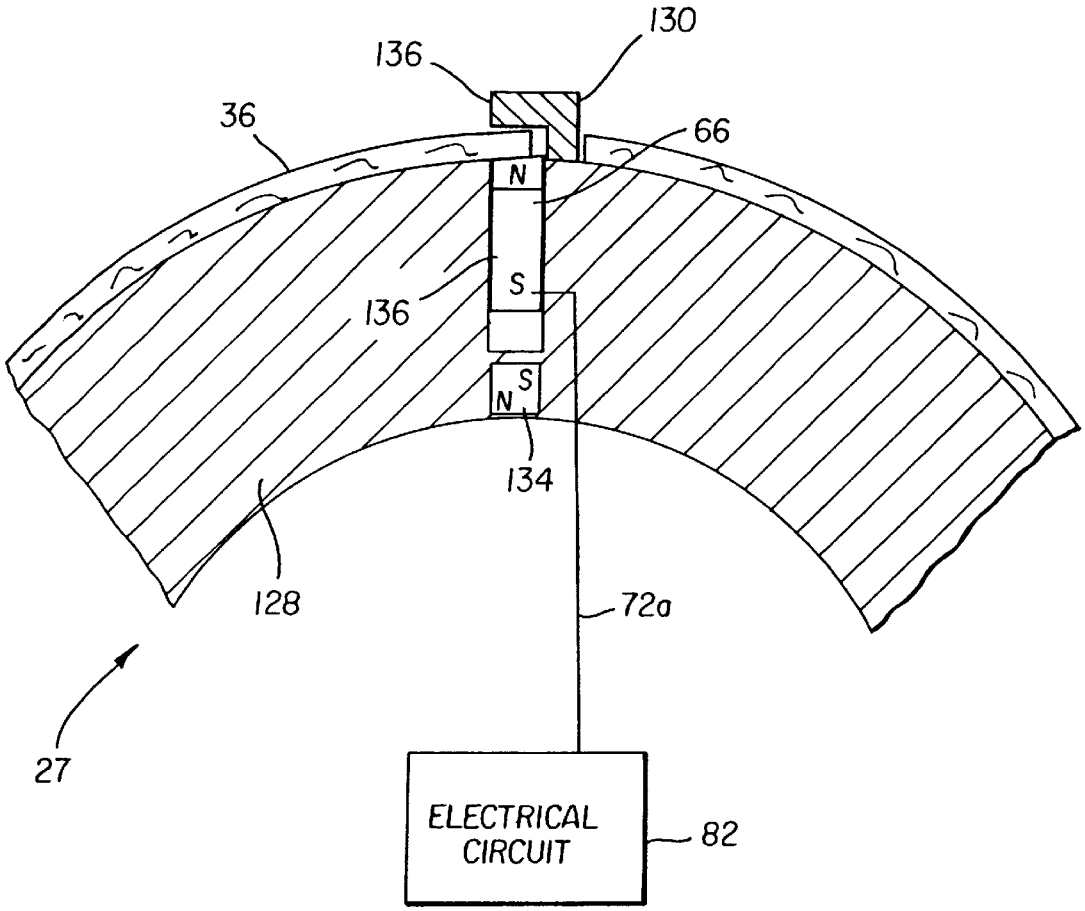
FIG. 12 shows a cross-section diagram of an embodiment of the drum of the present invention wherein electrical contacts are incorporated into clamps.

In the forgoing embodiments, the electrical conductor of the present invention have been described and shown as being stand alone structures. However it will be appreciated that electrical conductors 62, 64 and 66 can be incorporated into other structures such as a clamp 130 that are used to hold printing plate 36 to imaging drum 28. An example of this is shown in FIG. 12 wherein conductor 62 is incorporated into a clamp 130 located on imaging drum 128. In this example slide 132 is magnetically biased by magnet 134 to hold plate 36 against retainer 136. In this embodiment, slide 132 acts as an electrical short detection conductor 62 and is connected by way of conductor 72*a* to electrical circuit 82.

Figure 13A:
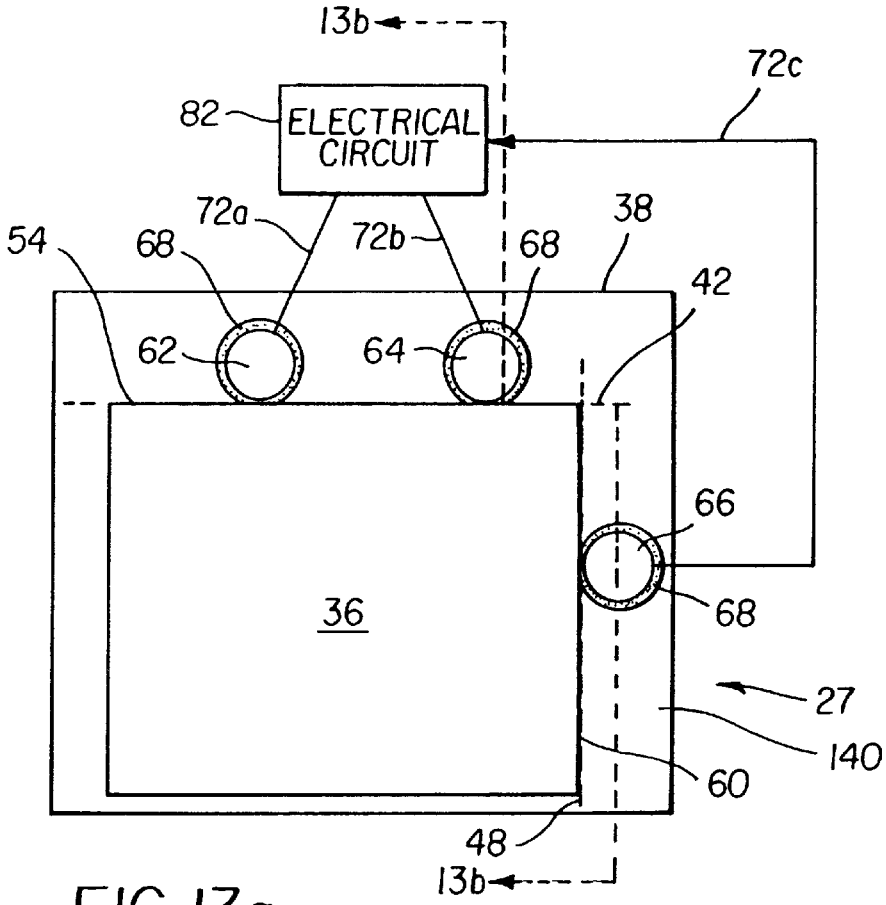
FIG. 13*a* shows a planar view of an imaging plate embodiment of the present invention.
Figure 13B:
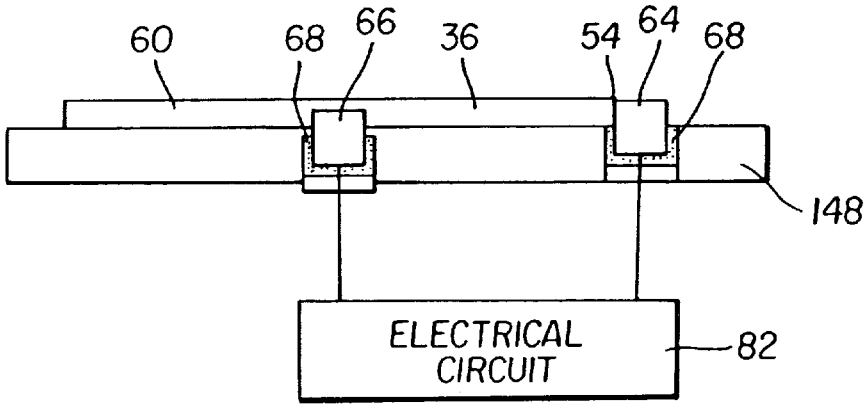
FIG. 13*b* shows a cross-section view of an imaging plate embodiment of the present invention.

Also in the forgoing, the mounting surface 27 of the present invention has been described as being an imaging drum 28. However, the mounting surface 27 of the present invention can comprise any number of surfaces that are adapted to receive and hold a printing plate 36. FIGS. 13*a* and 13*b* show a top and cross-section view of an embodiment of the present invention wherein the mounting surface 27 comprises a mounting platen 140. As is shown in this embodiment, mounting platen 140 has a planar outer surface 38 adapted to hold printing plate 36 to the mounting surface 27. This embodiment of the present invention can incorporate any of the above described features of any embodiment of the present invention described with respect to imaging drum 28. Consistent with the present invention, mounting surface 27 can also comprise other convenient forms well known to those in the art of printing including, but not limited to, a printing plate.

In the above described embodiments, a combination of three electrical conductors 62, 64, and 66 has been shown. However, consistent with the principles of the present invention, additional electrical conductors can be incorporated into the mounting surface as may be necessary to provide additional control surfaces. Further, the electrical conductors 62, 64, and 66 have been shown in an arrangement patterned to cooperate with the edge features of printing plate 36. It will be appreciated from this that printing plate 36 may have other edge features that will require different arrangements of electrical conductors 62, 64 and 66 in order to detect proper registration of such a printing plate 36.

The invention has been described in detail with particular reference to certain preferred embodiments thereof, but it will be understood that variations and modifications can be effected within the spirit and scope of the invention.

PARTS LIST

20 imaging apparatus
22 housing
24 sheet material supply assembly
26 imager
27 mounting surface
28 imaging drum
30 motor
34 output area
36 printing plate
37 printing surface
38 outer surface
40 imaging area
42 first axial and boundary
44 second axial boundary
46 left lateral boundary
48 second lateral boundary
50 direction of rotation
52 scanning direction
54 leading edge
56 trailing edge
58 left edge
60 right edge
62 electrical conductor
64 electrical conductor
66 electrical conductor
68 electrical insulator
70 electrical conductor
72*a* transmission lines
72*b* transmission lines
72*c* transmission lines
74*a* contact
74*b* contact
74*b* contact
76*a* slip ring
76*b* slip ring
76*c* slip ring
80 drum central shaft
82 electrical short detection circuit
84 signal generator
86 signal detector
88 output
90 charge generator
94 tuned coil
95 imaging apparatus controller
96 radio frequency detector
100 imaging apparatus
104 receiver media
112 source of receiver media
114 contact sleeve
116 output area
128 imaging drum
130 clamp
132 slide
134 magnet
136 retainer
140 imaging platen

What is claimed is:

1. An imaging apparatus for forming images on an at least partially electrically conductive printing plate; the imaging apparatus comprising:

a mounting surface having at least three electrically isolated conductors arranged so that when the electrically conductive printing plate is in registration on the mounting surface the electrically conductive printing plate defines an electrical connection between all of the electrical conductors;

an electrical circuit adapted to sense an electrical connection between all of the conductors and to thereupon generate an output signal; and a charge generator to electrically charge the mounting surface to attract the printing plate to the mounting surface and wherein the electrical circuit detects an electrical connection between each of the electrical conductors by detecting the presence of charge at all of the conductors.

2. An imaging apparatus for forming images on an at least partially electrically conductive printing plate; the imaging apparatus comprising:

a mounting surface having at least three electrically isolated conductors arranged so that when the electrically conductive printing plate is in registration on the mounting surface the electrically conductive printing plate defines an electrical connection between all of the electrical conductors;

an electrical circuit adapted to sense an electrical connection between all of the conductors and to thereupon generate an output signal; and a ground electrically connected to the printing plate wherein the electrical circuit comprises an electrical signal generator generating an electrical signal at each of the electrical conductors and the electrical signal generator is adapted to sense an electrical connection between the electrical conductors by detecting a ground at each of the conductors.

3. An imaging apparatus for forming images on an at least partially electrically conductive printing plate; the imaging apparatus comprising:

a mounting surface having at least three electrically isolated conductors arranged so that when the electrically conductive printing plate is in registration on the mounting surface the electrically conductive printing plate defines an electrical connection between all of the electrical conductors; and an electrical circuit adapted to sense an electrical connection between all of the conductors and to thereupon generate an output signal;

wherein the printing plate has axial and lateral edges and wherein all of the electrical conductors are positioned to contact an edge of the printing plate, at least one of the electrical conductors is arranged to engage a lateral edge and at least one of the electrical conductors is arranged to engage a longitudinal edge.

4. The imaging apparatus of claim 3 wherein the electrical circuit comprises a signal detector adapted to sense electrical signals at a first electrical conductor and an electrical signal generator generating an electrical signal at each of the remaining electrical conductors wherein the signal detector is adapted to generate an output when a signal at the first electrical conductor includes a signal from all of the remaining electrical conductors.

5. The imaging apparatus of claim 4, wherein the signal generator generates different electrical signals at each of the remaining electrical conductors and wherein the signal detector is adapted to detect each electrical signal and to generate a second output identifying the electrical conductors that are in contact with the printing plate.

6. The imaging apparatus of claim 4, wherein the electrical signal generator generates a separate voltage signal at each of the remaining electrical conductors and wherein the signal detector comprises a voltage signal detector.

7. The imaging apparatus of claim 6, wherein the signal detector comprises a voltage detector calibrated to detect each individual voltage signal and to generate a second output identifying conductors that are not in contact with the printing plate.

8. The imaging apparatus of claim 3, wherein the printing plate has a corner and electrical conductors are arranged to detect a corner of the printing plate.

9. The imaging apparatus of claim 3, wherein the output signal comprises a radio frequency signal and wherein the imaging apparatus has a radio frequency receiver to detect the radio frequency signal.

10. The imaging apparatus of claim 3, wherein the mounting surface comprises a rotatable drum.

11. The imaging apparatus of claim 10, wherein the output from the electrical circuit comprises an electrical signal transmitted to a rotating surface of the drum and wherein the imaging apparatus has a slip ring to engage the rotating surface of the drum.

12. The imaging apparatus of claim 3, wherein the mounting surface comprises a platen.

13. The imaging apparatus of claim 3, wherein the mounting surface comprises a printing plate.

14. The imaging apparatus of claim 3, wherein the printing plate has a conductive edge.

15. The imaging apparatus of claim 3, wherein the printing plate further comprises a conductive edge wrapping.

16. The imaging apparatus of claim 3, wherein the printing plate comprises at least two edges having a conductive coating.

17. The imaging apparatus of claim 3, wherein the printing plate has at least two electrically conductive edges and the electrical conductors extend from the mounting surface to define electrically conductive abutments.

18. The imaging apparatus of claim 17, wherein the printing plate has axial and lateral edges and wherein all of the electrical conductors are positioned to contact an edge of the printing plate, at least one of the electrical conductors is arranged to engage a lateral edge and at least one of the electrical conductors is arranged to engage a longitudinal edge.

19. The imaging apparatus of claim 18, wherein the printing plate has a corner and wherein electrical conductors are arranged to detect a corner of the printing plate.

20. A mounting surface for receiving electrically conductive printing plates; the mounting surface comprising:

an outer surface having at least three electrically isolated conductors arranged so that when the electrically conductive printing plate is in registration on the mounting surface the electrically conductive printing plate defines an electrical connection between all of the electrical conductors;

an electrical circuit adapted to sense an electrical connection between all of the conductors and to thereupon generate an output; and a charge generator to electrically charge the mounting surface to attract the printing plate to the mounting surface and wherein the electrical circuit detects an electrical connection between each of the electrical conductors by detecting the presence of charge at all of the electrical conductors.

21. The mounting surface of claim 20 wherein the electrical circuit comprises a signal detector adapted to sense electrical signals at a first electrical conductor and an electrical signal generator generating an electrical signal at each of the remaining electrical conductors wherein the signal detector is adapted to generate an output when a signal at the first electrical conductor includes a signal from all of the remaining electrical conductors.

22. The mounting surface of claim 21, wherein the signal generator generates different electrical signals at each of the remaining electrical conductors and wherein the signal detector is adapted to detect each individual signal and to generate a second output identifying the electrical conductors that are in contact with the printing plate.

23. The mounting surface of claim 21, wherein the electrical signal generator generates a separate voltage at each of the remaining electrical conductors and wherein the signal detector comprises a voltage level detector.

24. The mounting surface of claim 23, wherein the signal detector comprises a voltage detector calibrated to detect each individual voltage level and to generate a second output identifying those conductors that are not in contact with the printing plate.

25. A mounting surface for receiving electrically conductive printing plates; the mounting surface comprising:

an outer surface having at least three electrically isolated conductors arranged so that when the electrically conductive printing plate is in registration on the mounting surface the electrically conductive printing plate defines an electrical connection between all of the electrical conductors;

an electrical circuit adapted to sense an electrical connection between all of the conductors and to thereupon generate an output; and a ground electrically connected to the printing plate wherein the electrical circuit comprises an electrical signal generator generating an electrical signal at each of the electrical conductors and the electrical signal generator is adapted to sense an electrical connection between the electrical conductors by detecting a ground at each of the electrical conductors.

26. A mounting surface for receiving electrically conductive printing plates; the mounting surface comprising:

an outer surface having at least three electrically isolated conductors arranged so that when the electrically conductive printing plate is in registration on the mounting surface the electrically conductive printing plate defines an electrical connection between all of the electrical conductors; and an electrical circuit adapted to sense an electrical connection between all of the conductors and to thereupon generate an output;

wherein the printing plate has axial and lateral edges and wherein all of the electrical conductors are positioned to contact an edge of the printing plate, at least one of the electrical conductors is arranged to engage a lateral edge and at least one of the electrical conductors is arranged to engage a longitudinal edge.

27. The mounting surface of claim 26, wherein the printing plate has a corner and the electrical conductors are arranged to detect a corner of the printing plate.

28. The mounting surface of claim 26, wherein the output from the electrical circuit comprises a radio frequency signal and wherein the imaging apparatus has a radio frequency receiver to detect the radio frequency signal.

29. The mounting surface of claim 26, wherein the mounting surface comprises a rotatable drum.

30. The mounting surface of claim 26, wherein the output from the electrical circuit comprises an electrical signal transmitted to a rotating surface of the drum and wherein the imaging apparatus has a slip ring to engage the rotating surface of the drum.

31. The mounting surface of claim 26, wherein the mounting surface comprises a platen.

32. The mounting surface of claim 26, wherein the mounting surface comprises a printing plate.

33. The mounting surface of claim 26, wherein the printing plate comprises a conductive edge.

34. The mounting surface of claim 26, wherein the printing plate comprises conductive edge wrapping.

35. The mounting surface of claim 26, wherein the printing plate comprises at least two edges having a conductive coating.

36. The mounting surface of claim 26, wherein the printing plate has at least two electrically conductive edges and the electrical conductors extend from the mounting surface to define electrically conductive abutments.

37. The mounting surface of claim 36, wherein the printing plate has axial and lateral edges and wherein all of the electrical conductors are positioned to contact an edge of the printing plate, at least one of the electrical conductors is arranged to engage a lateral edge and at least one of the conductors is arranged to engage a longitudinal edge.

38. The mounting surface of claim 37, wherein the printing plate has a corner and the electrical conductors are arranged to detect a corner of the printing plate.

* * * * *